US010718152B2

(12) United States Patent
Brandes et al.

(10) Patent No.: US 10,718,152 B2
(45) Date of Patent: Jul. 21, 2020

(54) DOOR, WINDOW, OR FACADE ELEMENT AND FITTING ARRANGEMENT FOR SUCH AN ELEMENT

(71) Applicant: SCHÜCO INTERNATIONAL KG, Bielefeld (DE)

(72) Inventors: Matthias Brandes, Vlotho (DE); André Porombka, Bielefeld (DE); Fabrice Sobolowski, Bielefeld (DE); Sebastian Kreft, Enger (DE); Annika Blome, Enger (DE)

(73) Assignee: SCHÜCO INTERNATIONAL KG, Bielefeld (DE)

( * ) Notice: Subject to any disclaimer, the term of this patent is extended or adjusted under 35 U.S.C. 154(b) by 0 days.

(21) Appl. No.: 16/078,898

(22) PCT Filed: Feb. 24, 2017

(86) PCT No.: PCT/EP2017/054361

§ 371 (c)(1),
(2) Date: Aug. 22, 2018

(87) PCT Pub. No.: WO2017/148822

PCT Pub. Date: Sep. 8, 2017

(65) Prior Publication Data

US 2019/0055773 A1 Feb. 21, 2019

(30) Foreign Application Priority Data

Feb. 29, 2016 (DE) ..... 10 2016 103 589
Jan. 10, 2017 (DE) ..... 10 2017 100 335

(51) Int. Cl.
*E04C 2/34* (2006.01)
*E06B 3/263* (2006.01)
(Continued)

(52) U.S. Cl.
CPC ..... *E06B 3/26305* (2013.01); *E06B 5/16* (2013.01); *E06B 5/161* (2013.01); *E06B 3/26301* (2013.01);
(Continued)

(58) Field of Classification Search
CPC ..... E06B 3/26305; E06B 5/16; E06B 5/161; E06B 2003/7046; E06B 2003/26394; E06B 2003/2639; E06B 3/26301
(Continued)

(56) References Cited

U.S. PATENT DOCUMENTS 3,093,217 A * 6/1963 Doede ..... E04B 2/96 49/DIG. 1
3,114,179 A * 12/1963 Briggs ..... E06B 3/26301 49/DIG. 1
(Continued)

FOREIGN PATENT DOCUMENTS

DE 2238862 A 2/1974
DE 7512814 U 8/1975
(Continued)

OTHER PUBLICATIONS

Deutsche Norm, "Doors; smoke control doors; definitions and requirements," DIN 18 095-1, Oct. 1988.
(Continued)

*Primary Examiner* — Basil S Katcheves
(74) *Attorney, Agent, or Firm* — Patent Portfolio Builders PLLC

(57) ABSTRACT

A window, door, or facade element includes an outer frame composed of out frame bars and a leaf frame composed of leaf frame bars. One or more of the outer frame bars and/or of the leaf frame bars has/have at least the following features: a base profile, on which two fastening grooves that are open in the same direction are formed for fixing a
(Continued)

corresponding fastener of a fitting arrangement, which bridges the intermediate space between the fastening grooves. The two fastening grooves have at least one latch for at least one counterpart latch, which can be attached without tools, of a fitting part arrangement. The fitting arrangement has a functional fitting on a fitting plate and at least one support element for supporting the fitting. The support element is designed for direct or indirect latching in the fastening grooves by means of the counterpart latch.

16 Claims, 19 Drawing Sheets

(51) Int. Cl.
*E06B 5/16* (2006.01)
*E06B 3/70* (2006.01)

(52) U.S. Cl.
CPC ..... *E06B 2003/2639* (2013.01); *E06B 2003/26394* (2013.01); *E06B 2003/7046* (2013.01)

(58) Field of Classification Search
USPC ..... 52/783.13
See application file for complete search history.

(56) References Cited

U.S. PATENT DOCUMENTS 3,866,355 A 2/1975 Jacob
3,908,313 A * 9/1975 Bierlich ..... E06B 3/26301 49/501
4,067,163 A * 1/1978 Hetman ..... E06B 3/267 156/285
4,096,678 A * 6/1978 Diels ..... B23P 11/00 52/396.05
4,461,133 A * 7/1984 Laroche ..... E06B 1/6007 49/DIG. 1
4,513,552 A * 4/1985 Breithaupt ..... E06B 3/16 52/204.597
4,524,112 A * 6/1985 Willert ..... E06B 3/273 428/595
4,875,316 A * 10/1989 Johnston ..... E06B 3/26336 52/204.593
5,117,601 A * 6/1992 Habicht ..... E06B 3/273 52/204.593
5,694,731 A 12/1997 Tonsmann et al.
5,727,356 A * 3/1998 Ensinger ..... E06B 3/26303 49/DIG. 1
5,822,926 A * 10/1998 Koike ..... E05B 9/08 49/394
5,988,321 A * 11/1999 Kondo ..... B66B 13/303 187/333
6,035,600 A * 3/2000 Habicht ..... E06B 3/26305 52/717.02
6,141,923 A * 11/2000 Habicht ..... E04B 1/943 52/232
6,401,396 B1 6/2002 Koban et al.
9,328,549 B1 * 5/2016 Alexander ..... E06B 1/325
9,441,412 B1 * 9/2016 Hooper, Jr. ..... E06B 3/263
9,995,081 B1 * 6/2018 Shearman ..... E06B 3/9641
2002/0002804 A1 * 1/2002 Sheehy ..... E04B 1/12 52/272
2013/0097934 A1 4/2013 Cook
2014/0053488 A1 * 2/2014 Lenox ..... E06B 3/26303 52/404.1

FOREIGN PATENT DOCUMENTS

DE 3709394 A1 10/1988
DE 4443762 A1 6/1996
DE 19700696 B4 7/2008
DE 202010011238 U1 11/2010
DE 102009044433 A1 5/2011
DE 202013104981 U1 2/2014
EP 1138864 B1 9/2004
EP 2116685 A2 11/2009
WO 0015937 A1 3/2000

OTHER PUBLICATIONS

Deutsche Norm, "Fire behaviour of building materials and components; tire barriers—concepts, requirements and testing," DIN 4102-5, Sep. 1989.
International Search Report dated May 26, 2017 in related International Application No. PCT/EP2017/054361.
Search Report created on Dec. 5, 2017 in related DE Application No. 10 2017 100 335.5.
Written Opinion dated May 26, 2017 in related International Application No. PCT/EP2017/054361.

* cited by examiner b)

c)

DOOR, WINDOW, OR FACADE ELEMENT AND FITTING ARRANGEMENT FOR SUCH AN ELEMENT

BACKGROUND AND SUMMARY OF THE INVENTION

Exemplary embodiments of the present invention relate to a door, a window, or a façade element comprising a frame and a sash, and also a fitting assembly for such an element.

Smoke protection doors (RS) according to DIN 18095 are self-closing doors that substantially prevent the passage of smoke in the installed and closed state. A fire protection closure alternatively or additionally has the object of securing openings in walls against the passage of fire. According to DIN 4102-5, there are the following fire protection classes: T30, T60, T90, T120, and T180. The number after the T indicates the duration in minutes, for which duration the fire protection closure prevents the passage of the fire (not of the smoke) and still has to be able to be opened.

Known designs meeting these requirements involve relatively complex production and manufacturing.

Exemplary embodiments of the present invention are directed to a door, a window, or a façade element respectively comprising a refined frame and a refined sash and/or an advantageous fitting assembly for such an element. The fitting assembly is to be installed easily and precisely in a simple manner on a smoke protection door (or a fire protection door or a corresponding window or façade element, respectively) at least according to the fire protection class T30.

It is therefore possible in a simple manner, in particular possible to fix, in particular fixedly lock a fitting assembly—in particular a lock assembly—as a preassembled unit on a main profile of a sash spar.

A window, a door, or a façade element is provided comprising a frame made of frame spars and comprising a sash made of sash spars, wherein one or more of the frame spars and/or the sash spars has/have at least the following features:

- a main profile, on which two fastening grooves open in the same direction are formed for fixing a corresponding fastening means of a fitting assembly bridging the intermediate space between the fastening grooves,
- wherein the two fastening grooves have at least one catch means for at least one counter catch means attachable without tools of a fitting part assembly,
- and wherein the fitting assembly has a functional fitting on a fitting plate and at least one carrier element for carrying the fitting plate, wherein the carrier element is designed for direct or indirect locking in the fastening grooves with its counter catch means.

The fitting assembly can be fixed without tools in a locking manner easily on the main profile in this manner.

According to one preferred variant, the fitting plate and the at least one carrier element are formed in multiple pieces and fastened on one another. According to another variant, the fitting plate and the at least one carrier element are formed in one piece.

Two of the carrier elements are preferably formed on the fitting plate, in particular at the ends thereof, and therefore particularly secure fastening takes place.

According to a further variant, the functional fitting is a lock and the fitting plate is a striker plate, on which the lock is arranged. According to another variant, the functional fitting is a movable or immovable pin arranged on the fitting plate.

According to a further advantageous variant, the carrier element has a U shape in cross section comprising a main leg and two parallel longitudinal legs. In this case, the parallel longitudinal legs are spaced apart from one another such that they can engage in the fastening grooves of the main profile, and the counter catch means for interacting with the catch means of the fastening grooves are formed directly or indirectly at the ends of the two longitudinal legs. The fitting assembly is thus fixedly locked using few elements in a simple and tool-free manner on the sash, in particular on the main profile thereof. In this case, it remains displaceable in the fastening grooves, preferably in the main extension direction of the profile, and therefore the fitting assembly is displaceable in a simple manner to a predefined position, at which the fitting assembly is to be fastened.

It is advantageous and structurally simple if the fitting assembly, in particular the lock assembly, which is fastened in a locking manner but is possibly still somewhat displaceable in the fastening grooves, is additionally fixed on the main profile or secured against slipping using a profile clamp arranged vertically below the fitting assembly.

It is expedient according to one variant if the two longitudinal legs have thickened areas at the ends thereof, each of which engage in securing clips that are lockable in the fastening grooves. According to a further advantageous variant, the at least one carrier element is formed as a profile section of a metal profile. It is furthermore expedient in this case if the securing clips consist of a plastic material.

The fitting assembly is preferably installable without tools on the main profile. It is furthermore advantageous if the fitting assembly has a frame-type fitting screen, wherein this screen can have inwardly protruding webs on its inner circumference, which are designed for the purpose of engaging behind the fitting plate, in particular the striker plate, to fix it in a simple manner.

Moreover, a fitting assembly for a window, a door, or a façade element is provided.

The fitting assembly is particularly suitable in this case for locking on a frame spar and/or sash spar for a frame and/or a sash of a window, a door, or a façade element, which respectively have at least the following features:

- a main profile having a substantially U-shaped cross section in one-piece or multipiece design, which, viewed in cross section, has a short leg and a long leg and a transverse leg formed between them,
- wherein an intermediate space, which is overlapped at least in sections by a fitting part and/or a cover element, is formed between the end regions of the short leg and the long leg facing away from the transverse leg,
- wherein both the short leg and the long leg of the main profile each have, on the inner sides thereof facing toward one another, multifunction contours, which entirely or partially delimit at least the following groove:
- respectively a fastening groove open on the side facing away from the transverse leg for fixing a corresponding fastening means of the fitting part and/or the cover element to overlap the intermediate space between the long leg and the short leg.

The two fastening means on the cover element or elements and/or on the fitting part or parts are each insertable perpendicularly to the transverse leg and parallel to the short leg and the long leg, in order to be fixed in the fastening grooves.

The fastening groove particularly preferably has at least one catch means for locking fixing of at least one corresponding counter catch means of the fitting part and/or possibly also the cover element.

According to one particularly preferred embodiment, the at least one cover element is a cover profile which forms a visual rabbet screen. This cover profile is clipped perpendicularly to the transverse leg into the fastening grooves, and therefore it is fixed therein. In this case, the catch connection on the cover profile preferably has enough play according to one variant that a clamping and therefore shear-resistant connection is not formed between the cover profile and the main profile, but rather the cover profile may be manually displaced without tools on the main profile. The cover profile then does not assume a static function—except in case of fire—and does not or does not noticeably stabilize the main profile. It is merely used to cover the gap/free space between the long leg and the short leg on the side thereof facing away from the main leg or transverse leg. The cover profile is preferably longer than 10 cm. It can cover the entire free space/gap between the short leg and the long leg over the complete length and is preferably solely not placed in the region of locks and fitting parts. Of course, a plurality of the cover profiles can also be provided. The sash and the frame are preferably provided with the cover profiles on multiple or even all parts.

Since the cover profile or profiles preferably do not assume a static function, they can simply be clipped onto the main profile perpendicularly to the transverse leg. For this purpose, it is in turn advantageous if the cover profiles are themselves U-shaped. In case of fire, it is advantageous if the cover profile or profiles consist entirely or partially of a foaming material.

BRIEF DESCRIPTION OF THE DRAWING FIGURES

Exemplary embodiments of the invention are illustrated in the drawings and will be described in greater detail hereafter. In the figures.

Figure 3A:
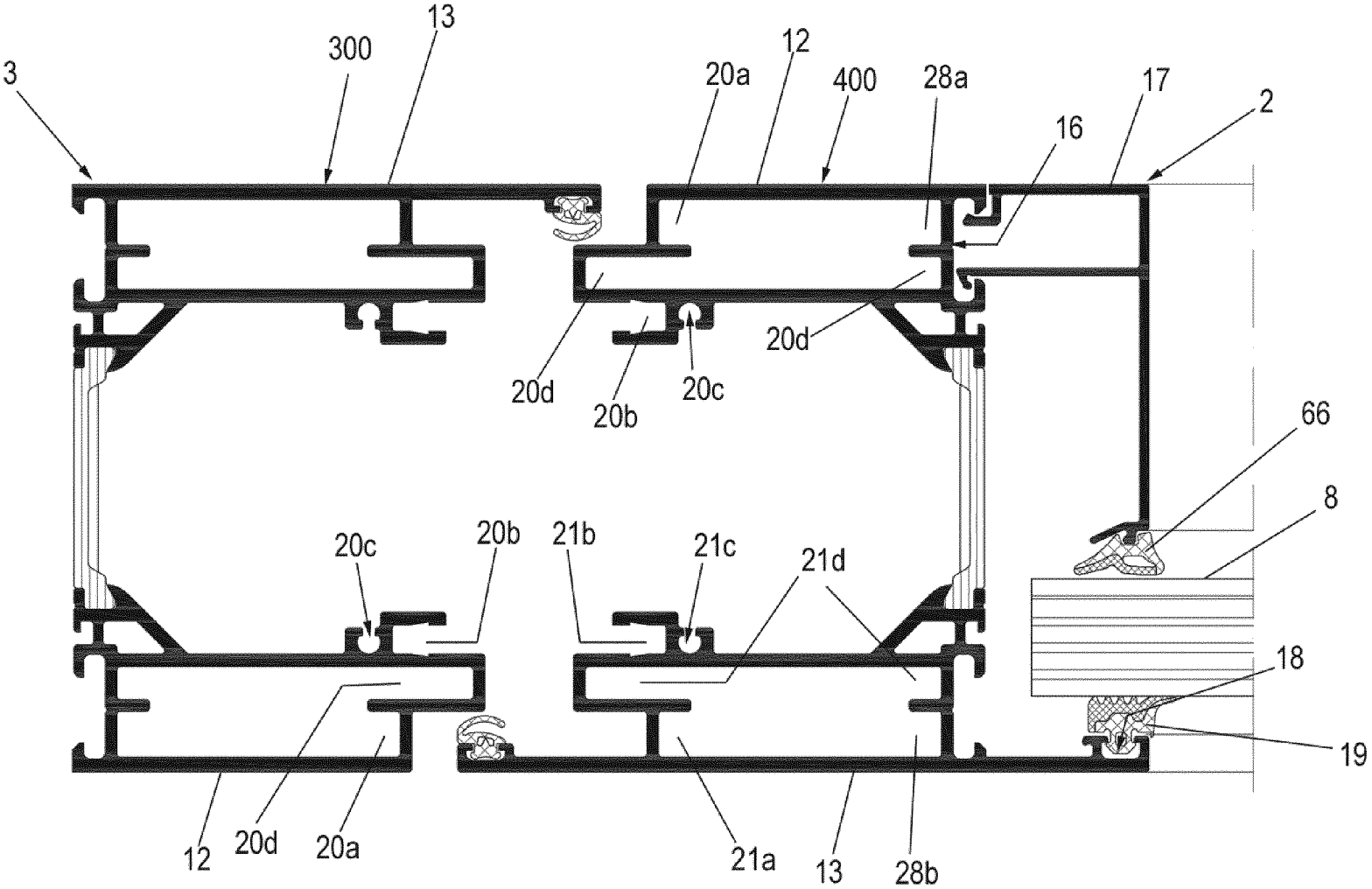
Figure 3:
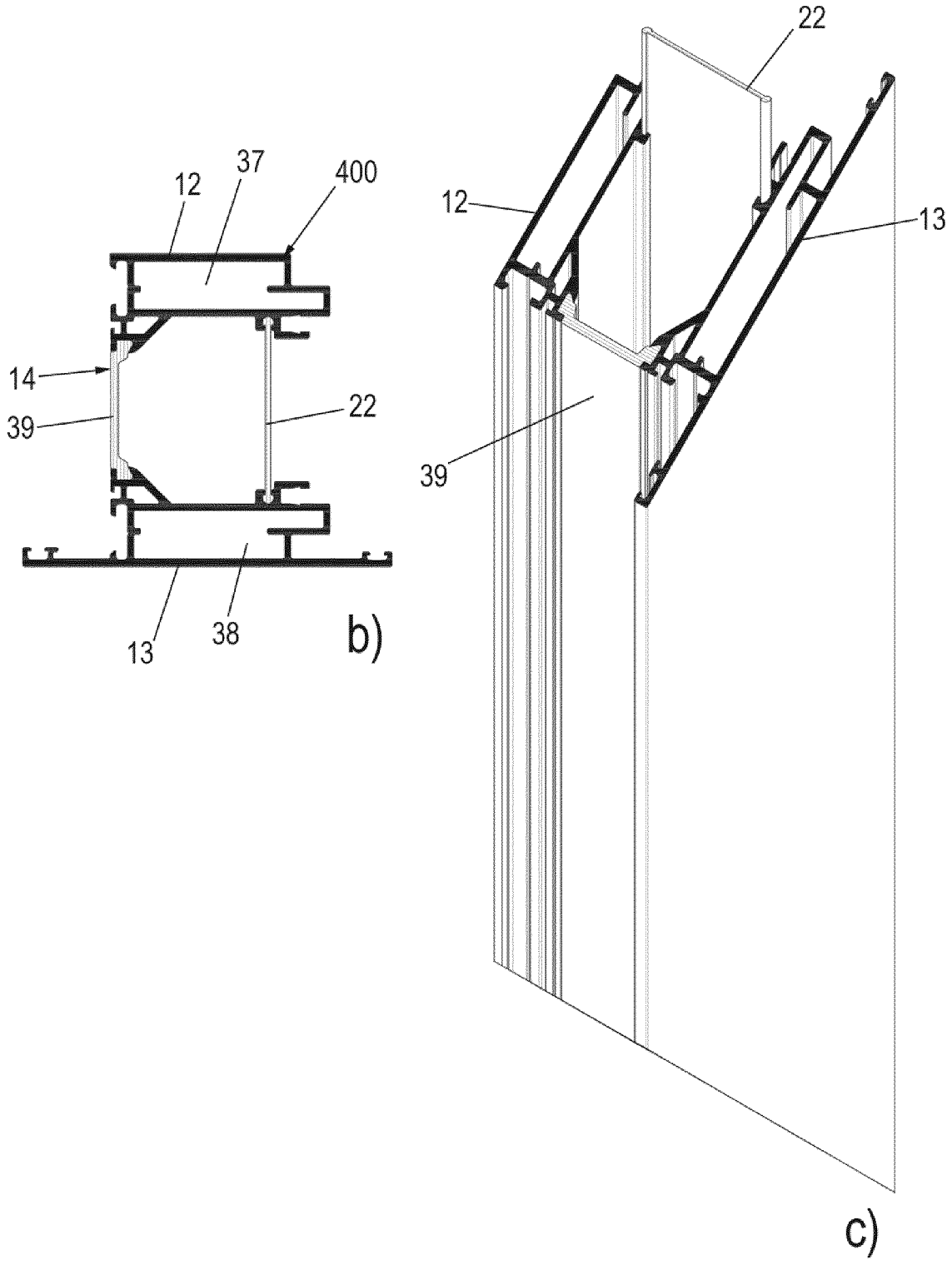
Figure 3:
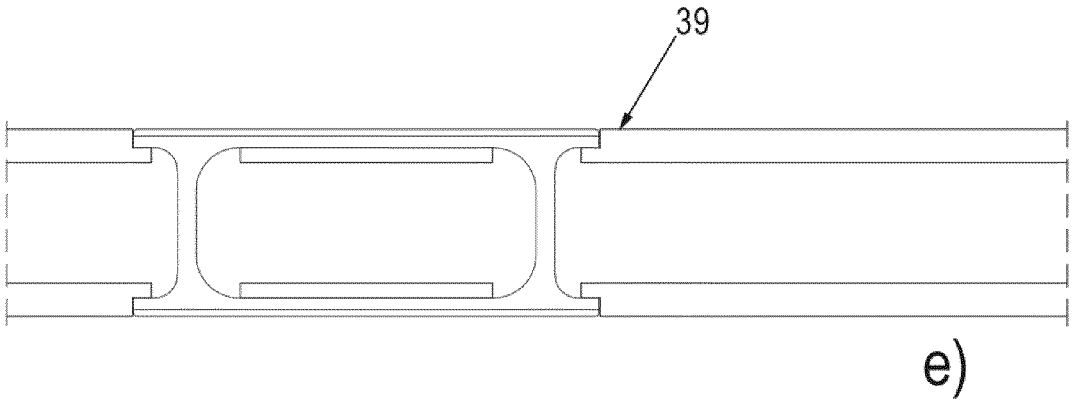
Figure 3:
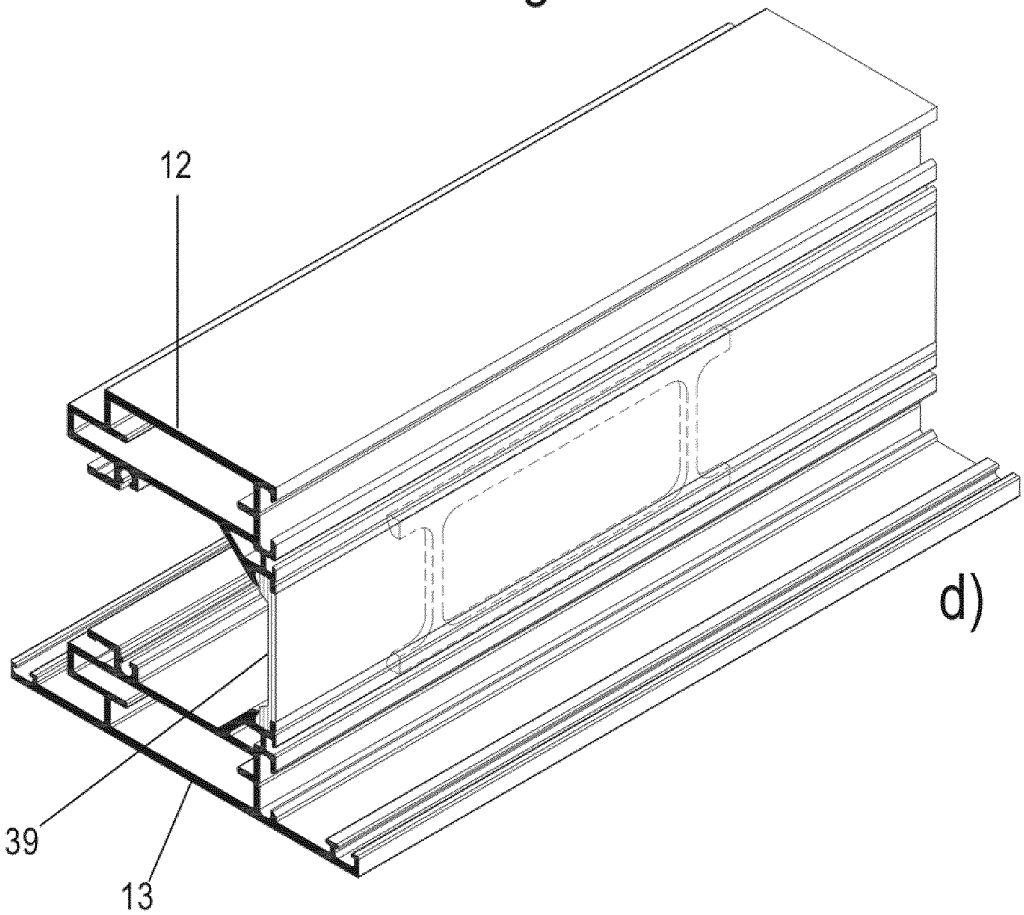
Figure 4:
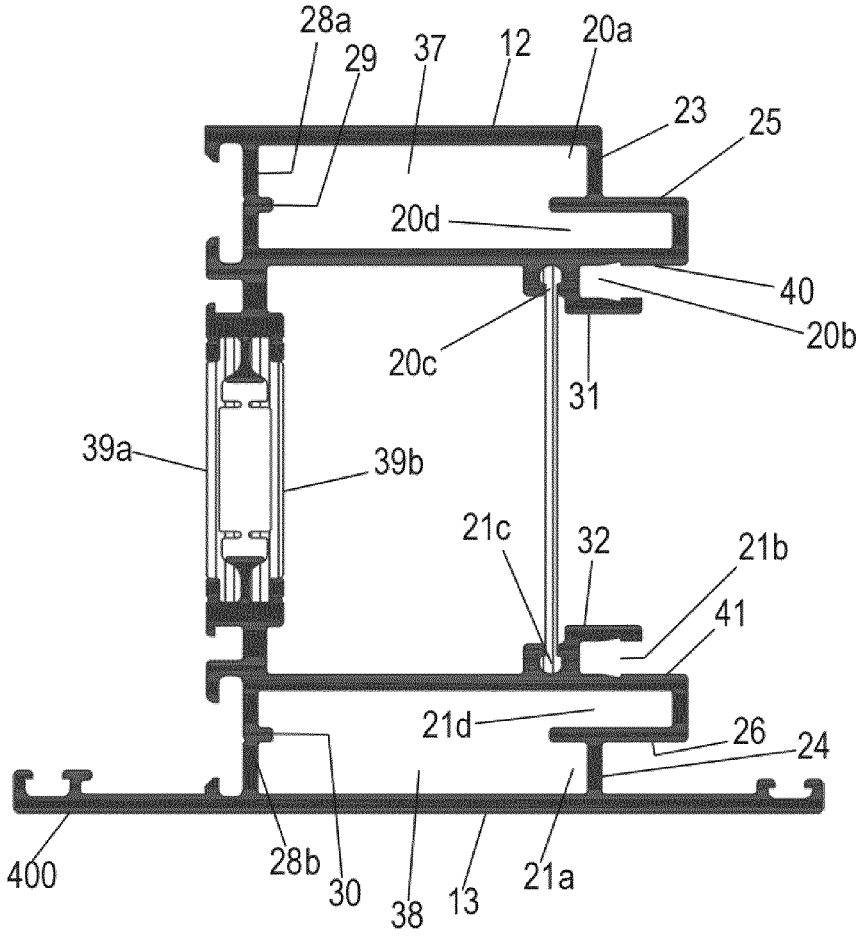
Figure 5:
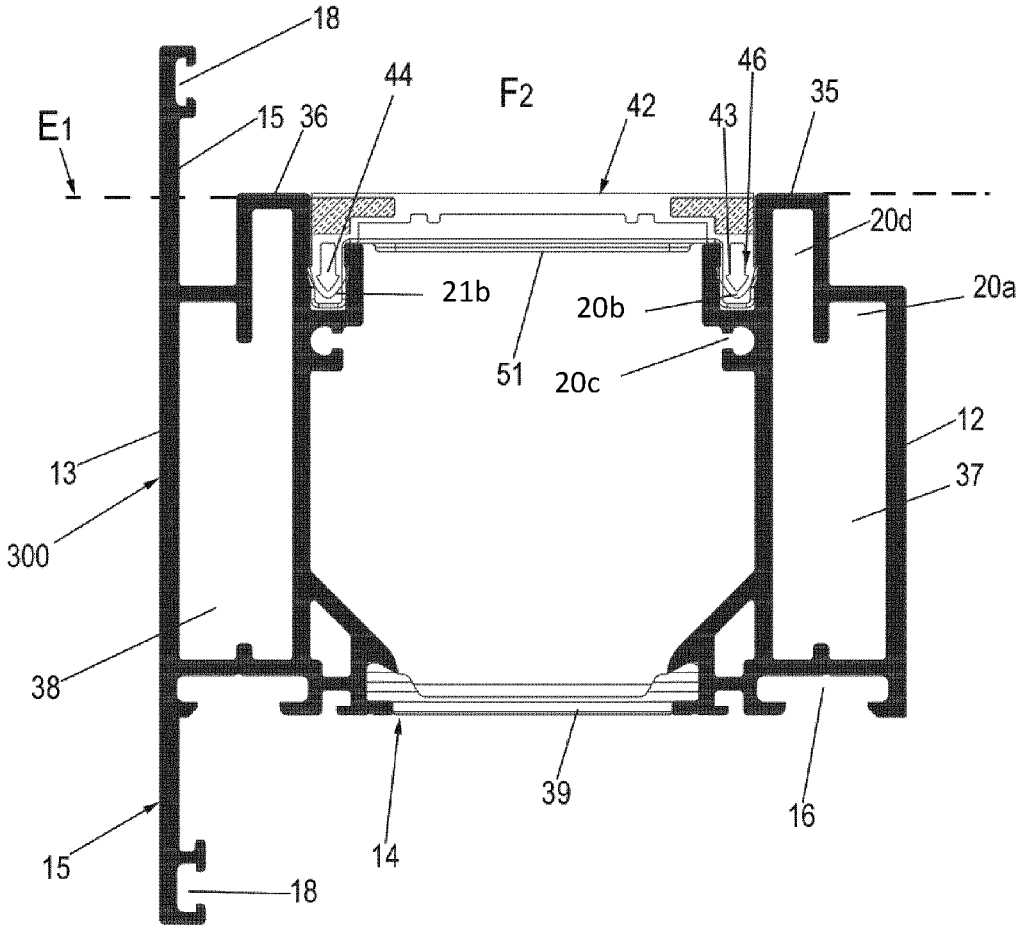
Figure 6:
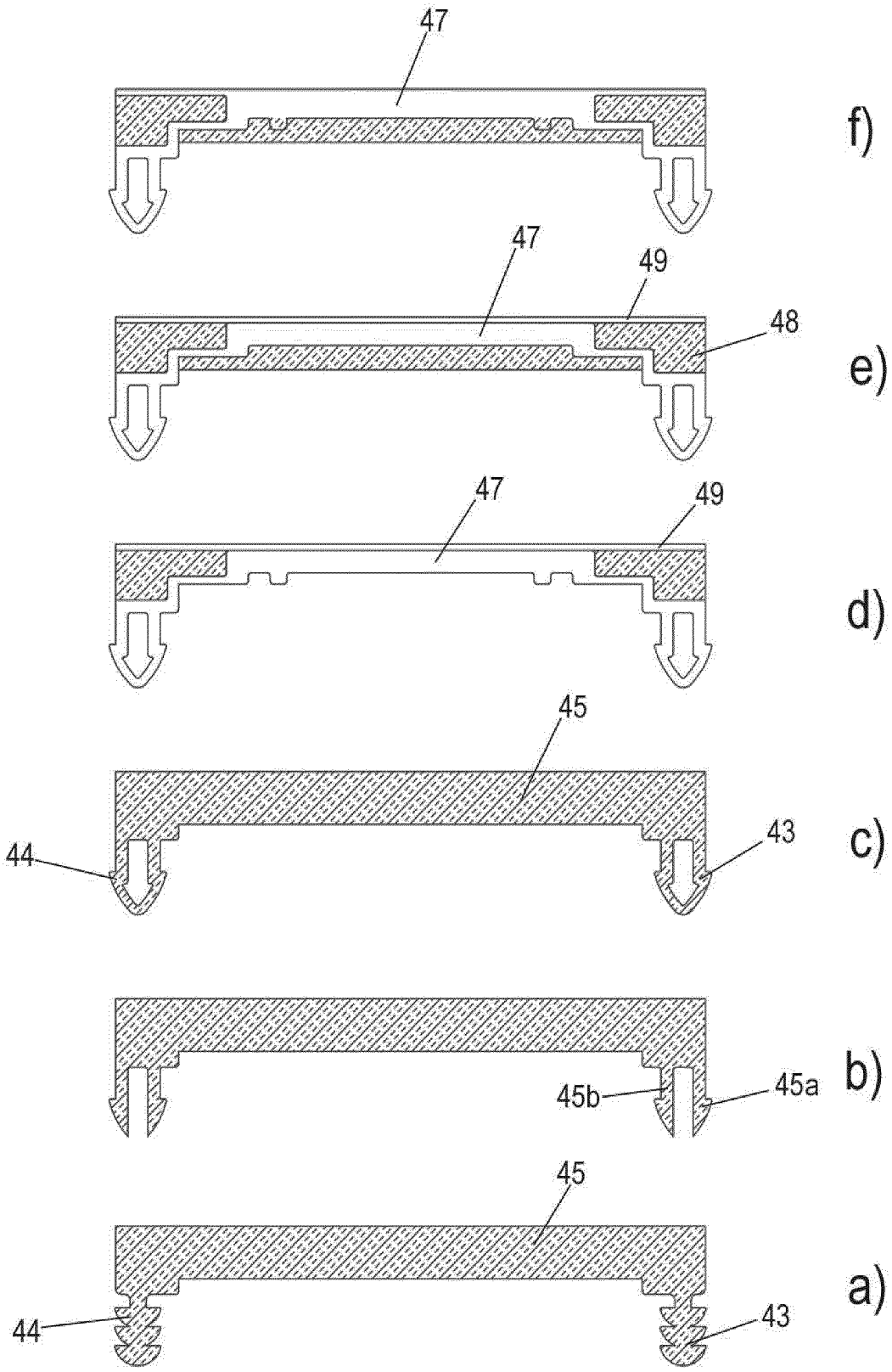
Figure 7:
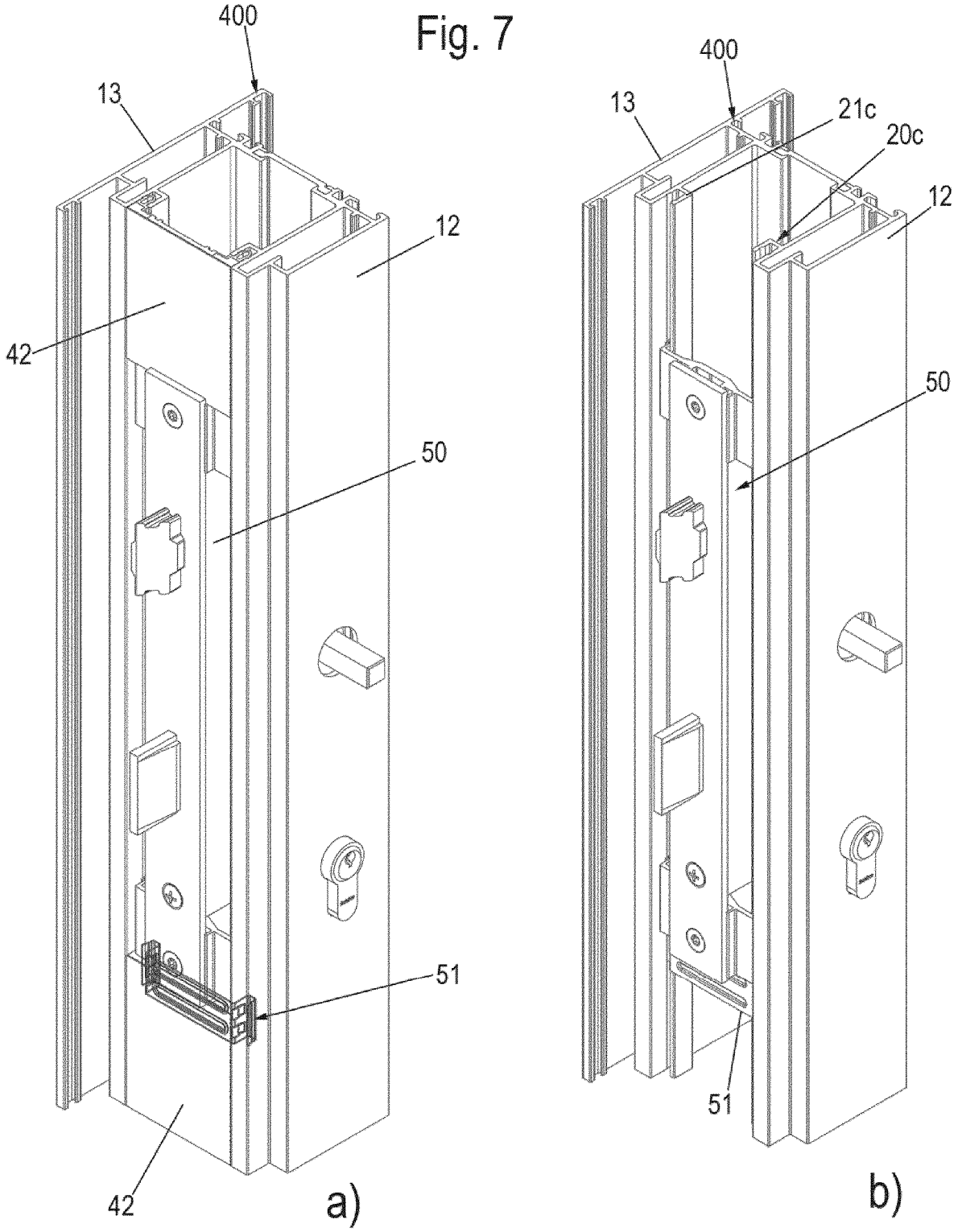
Figure 8:
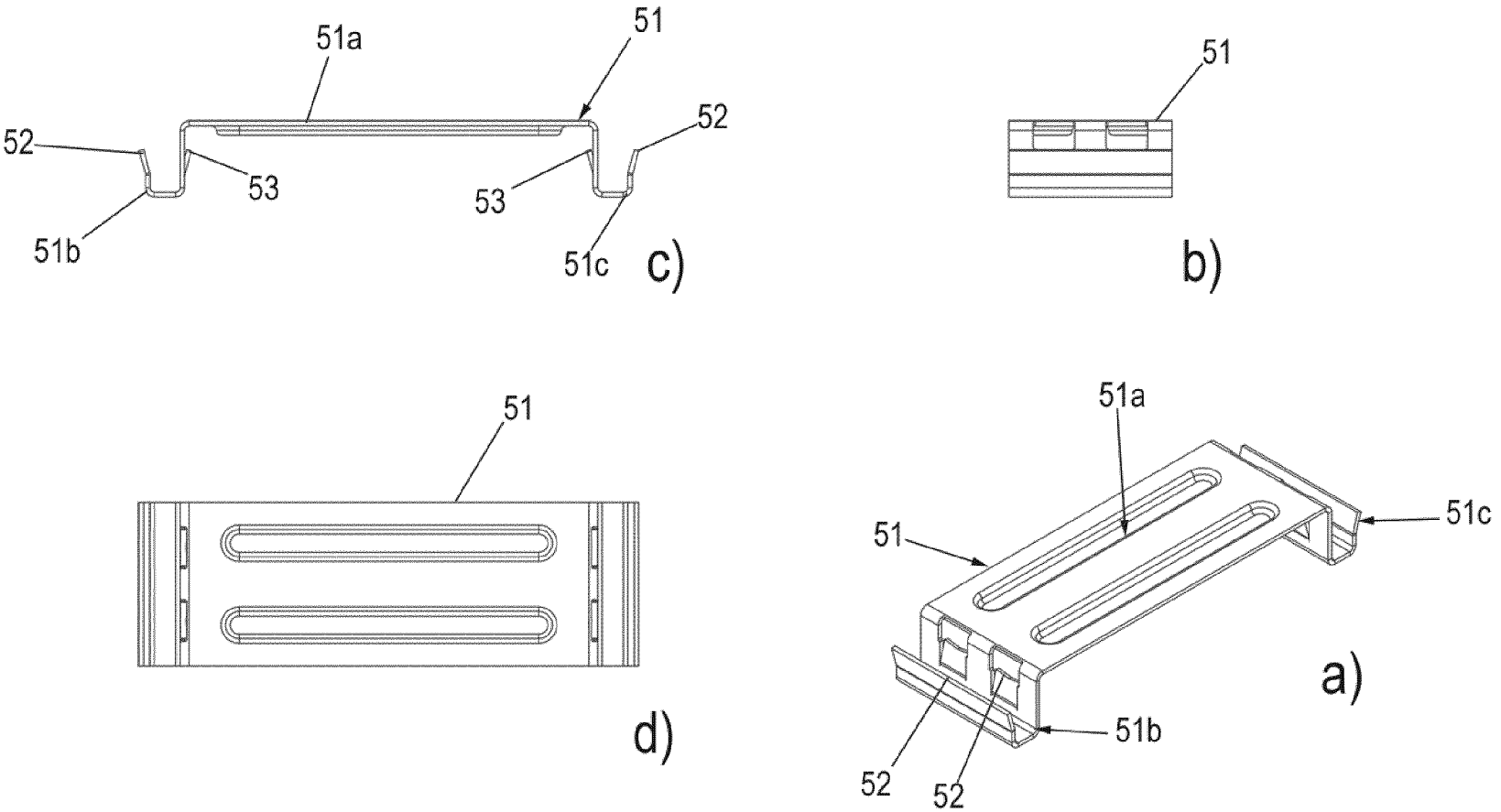
Figure 9:
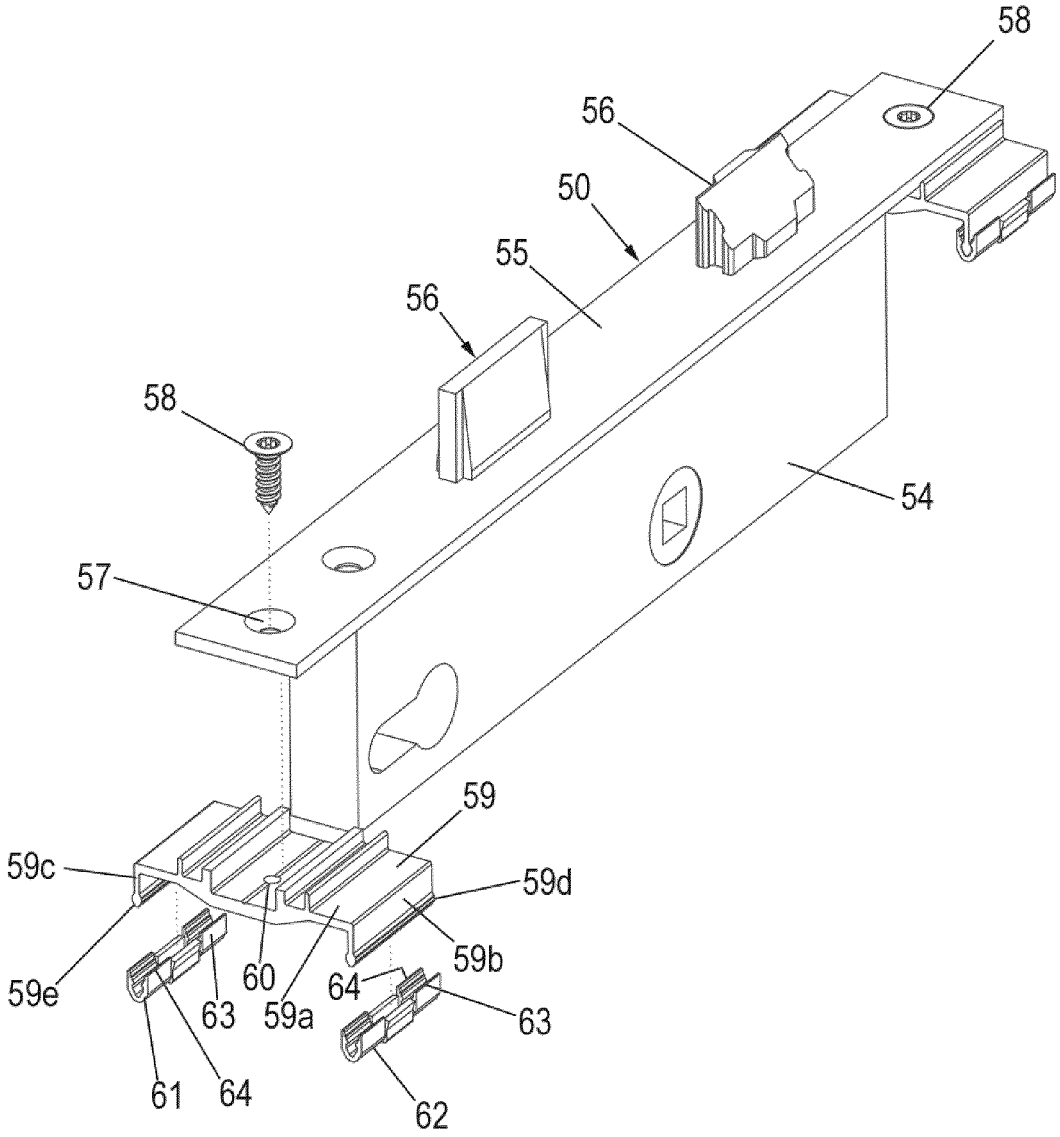
Figure 10:
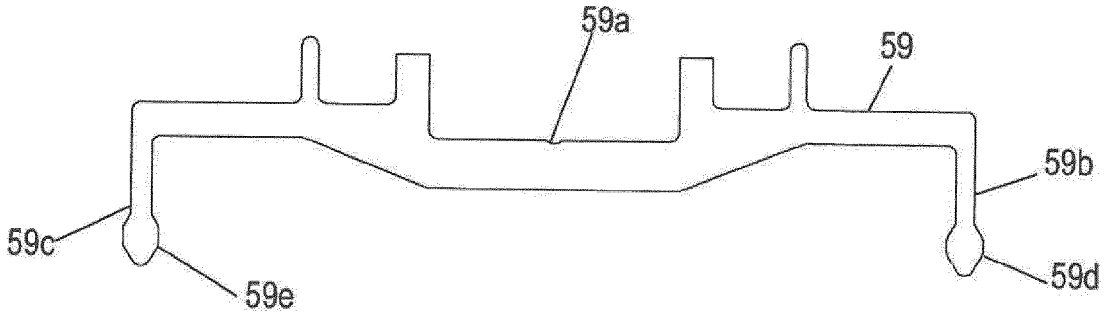
Figure 11:
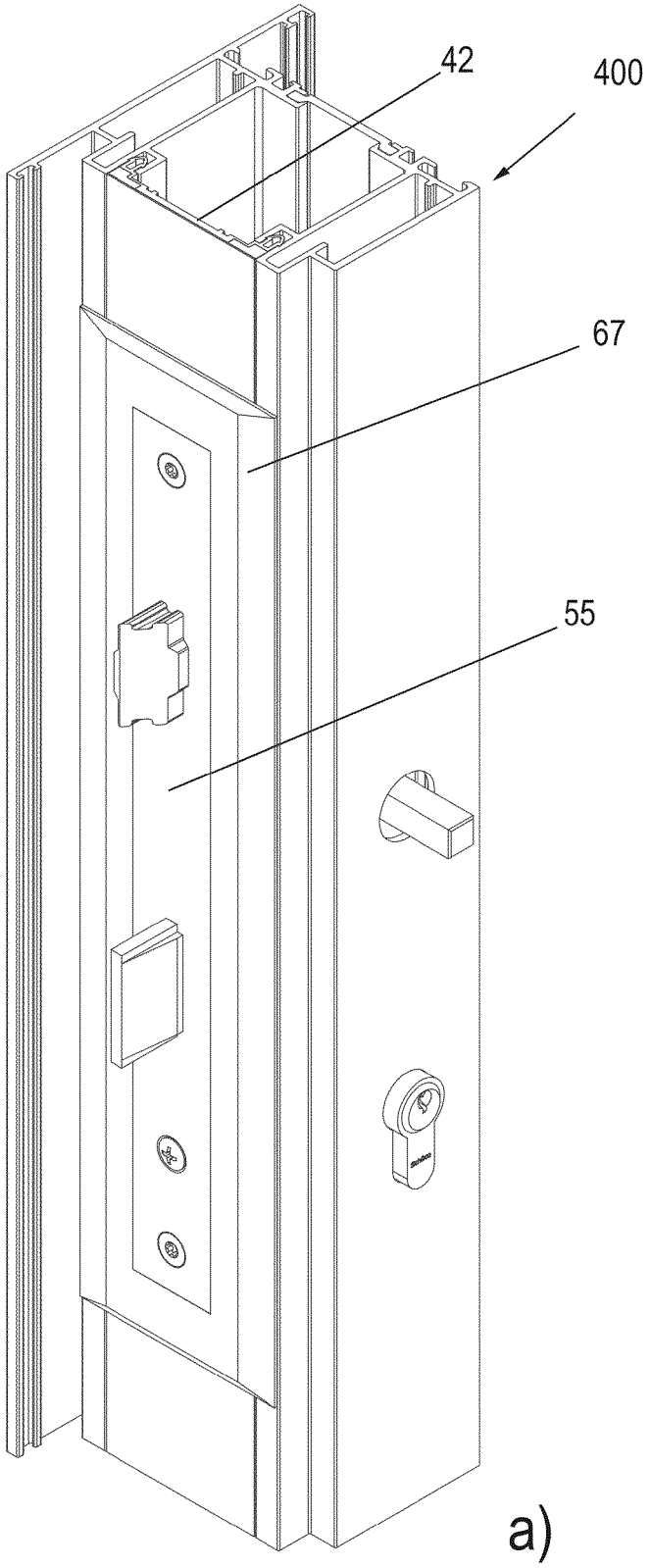
Figure 11:
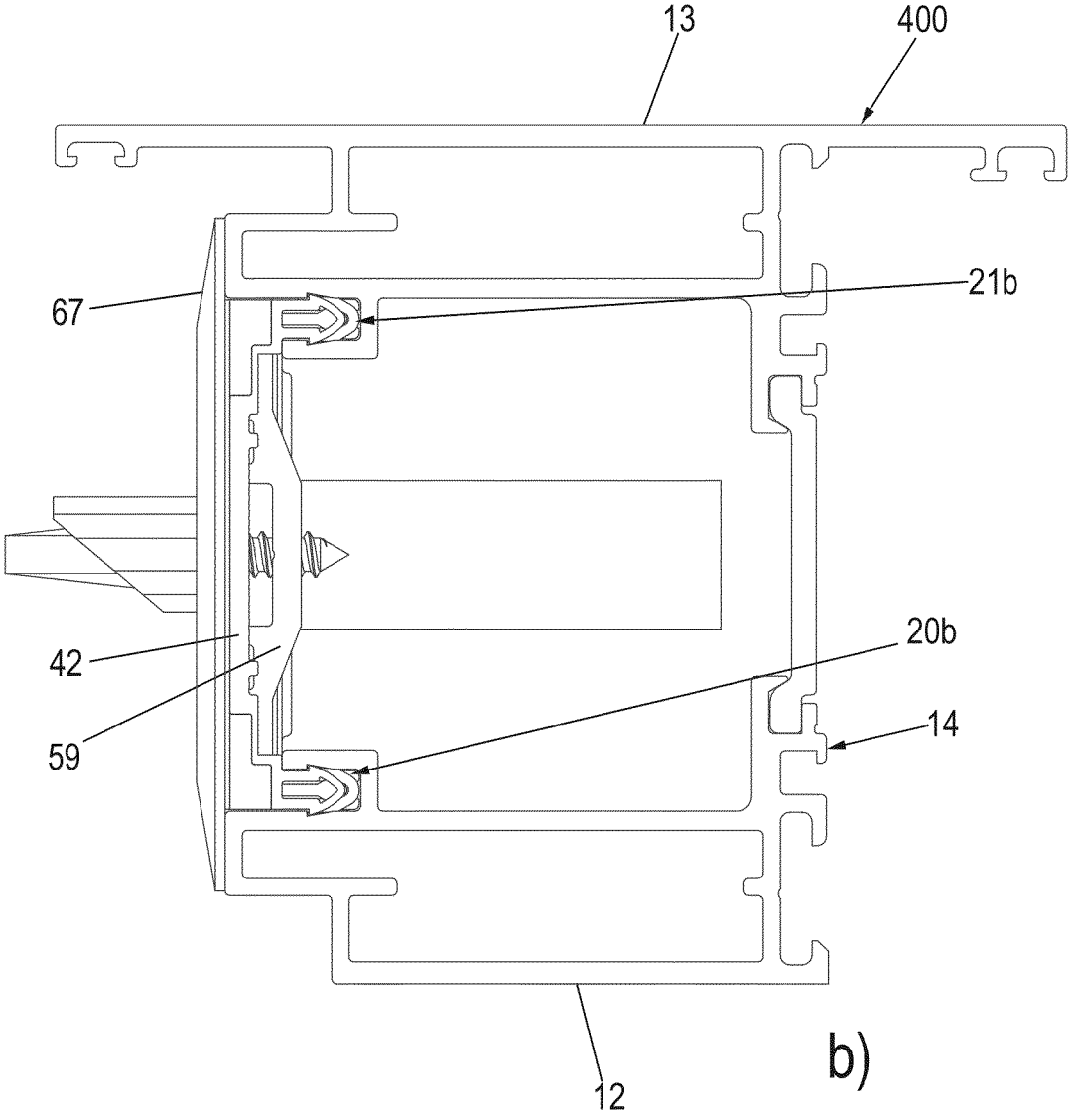
Figure 12:
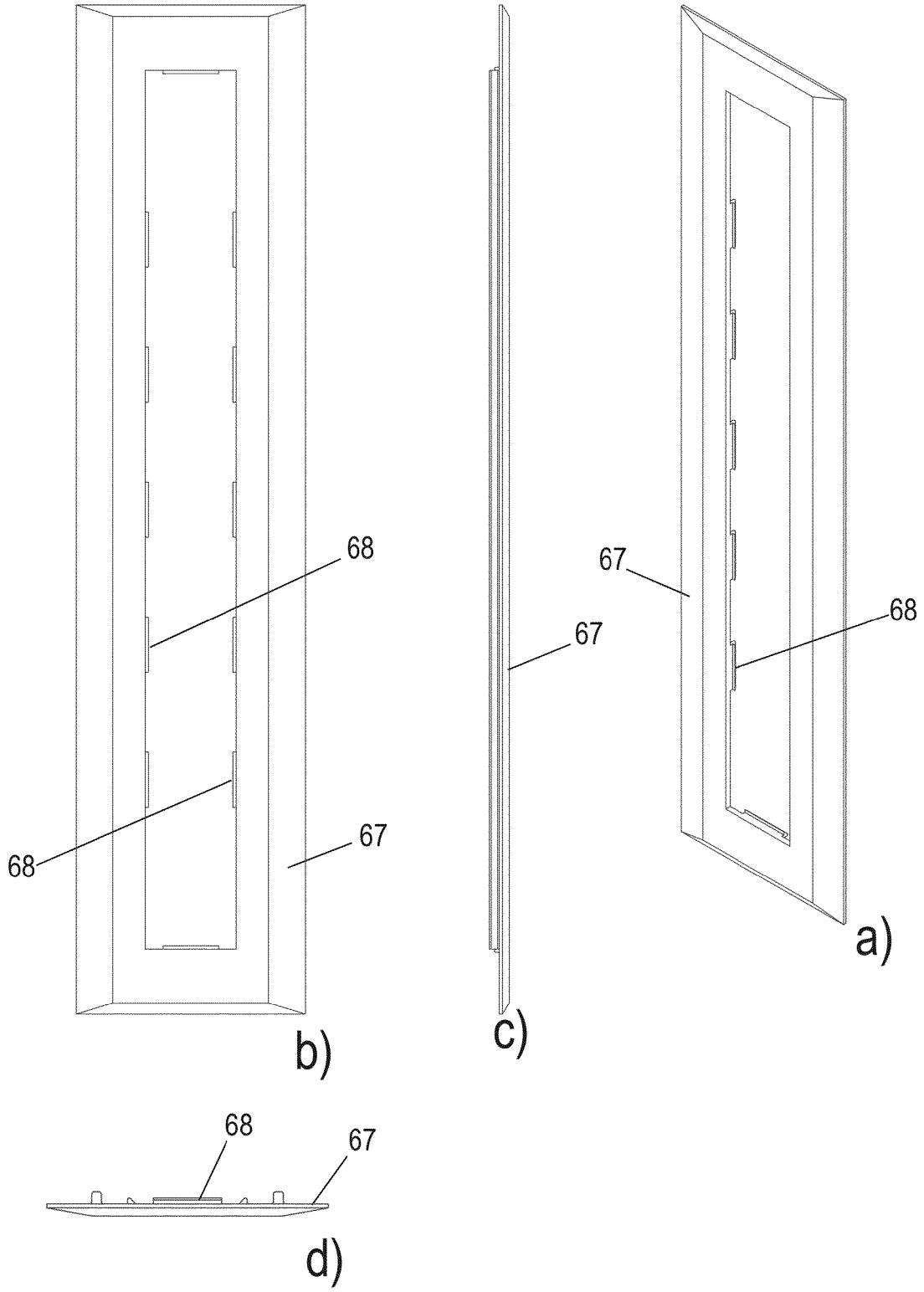
Figure 13:
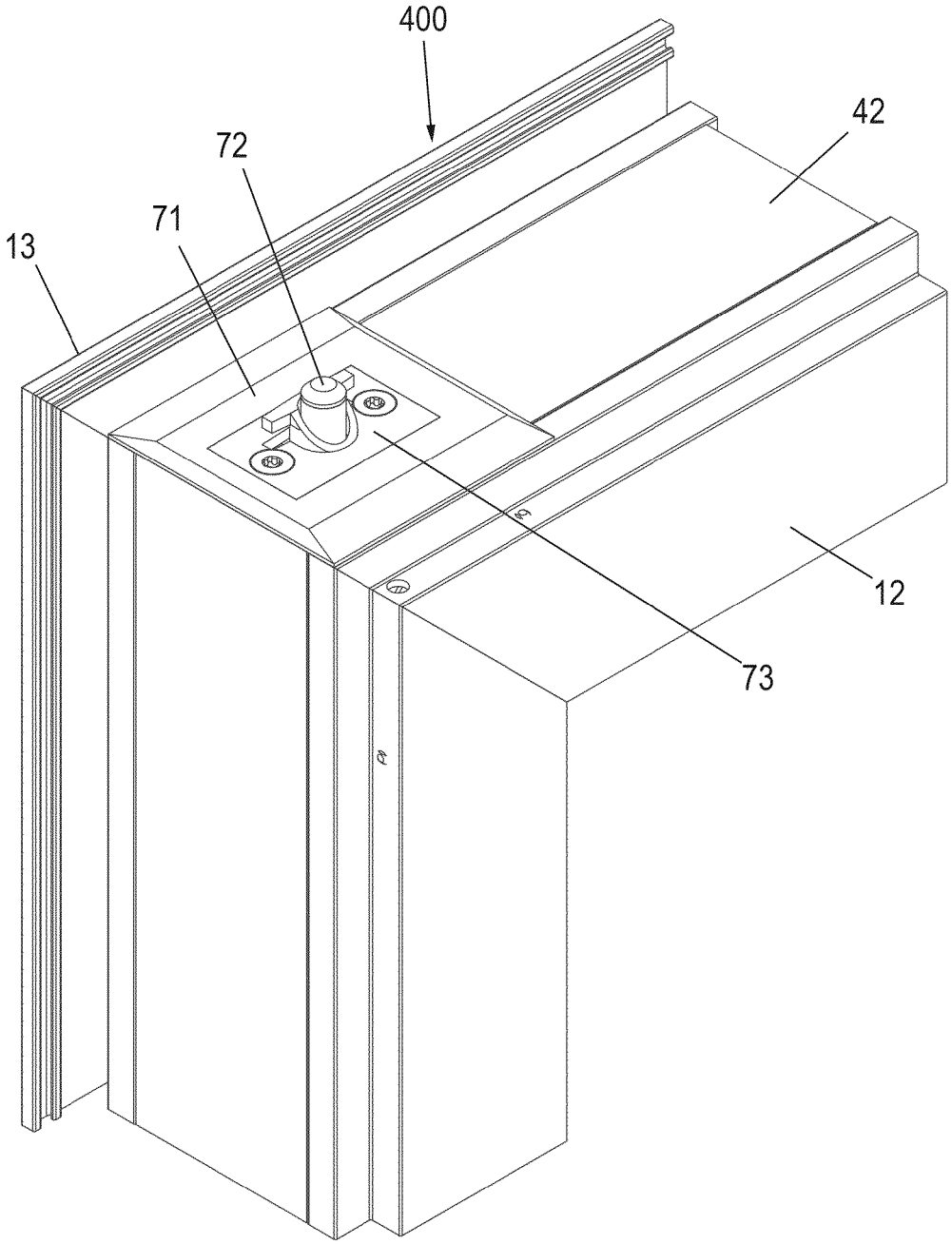
Figure 14:
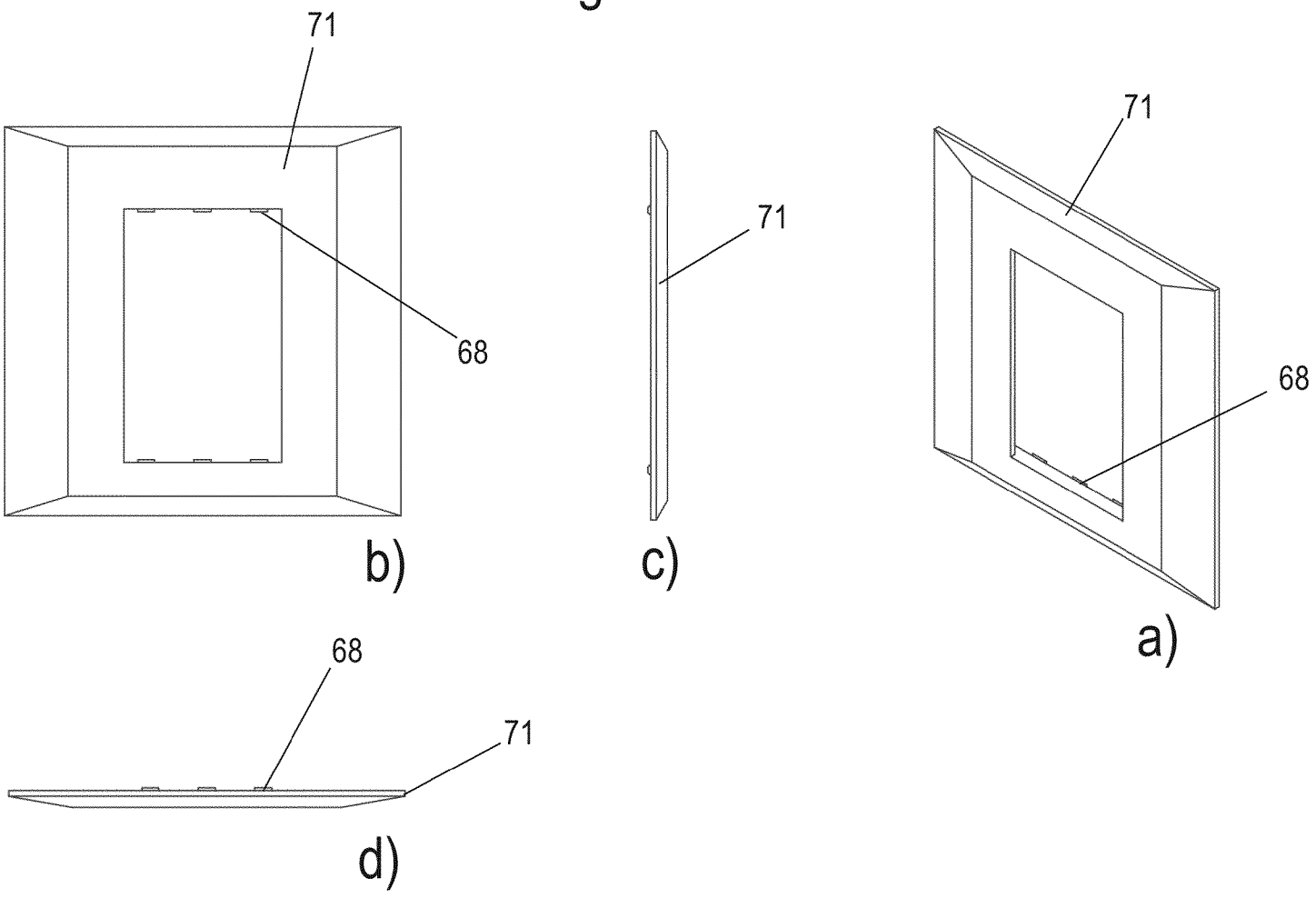

FIG. 3 shows, in a), a section through a sash spar and a frame spar of a further door of the type according to FIG. 1 in the closed state, in b), a sectional illustration of a main profile of the leaf from a), in c), a perspective illustration of the main profile from b) in a top view, in d), a further perspective view of the main profile from c) in a view from below, in e), a schematic view of an insulating web of the main profile from a) to d), and, in f), the arrangement from a) with corner connectors and cooling strips;

FIG. 4 shows a sectional illustration of a third main profile for a sash spar;

FIG. 5 shows the main profile of the sash spar from FIG. 3, provided with a cover profile;

FIG. 6 shows, in a) to f), sectional views of various cover profiles;

FIG. 7 shows, in a), a perspective view of a main profile with a lock assembly, with cover profiles, and with a profile clamp which is concealed per se but is visibly illustrated here, and, in b), the arrangement from a) without cover profiles, so that the profile clamp is partially directly visible;

FIG. 8 shows, in a) to d), various views of the profile clamp from FIG. 7; and FIG. 9 shows a perspective view of a lock comprising a carrier arrangement for fittings, in a preassembly position and in an exploded view;

FIG. 10 shows a carrier of the carrier arrangement from FIG. 9 in a side view:

FIG. 11 shows, in a), a perspective view of a main profile comprising a lock assembly and a fitting screen formed as a lock screen and, in b), a sectional view of the arrangement from a);

FIG. 12 shows, in a) to d), various views of the lock screen from FIG. 11;

FIG. 13 shows a perspective view of a corner region of a sash with a fitting assembly; and FIG. 14 shows, in a) to d), various views of the fitting screen from FIG. 13.

DETAILED DESCRIPTION

Figure 1:
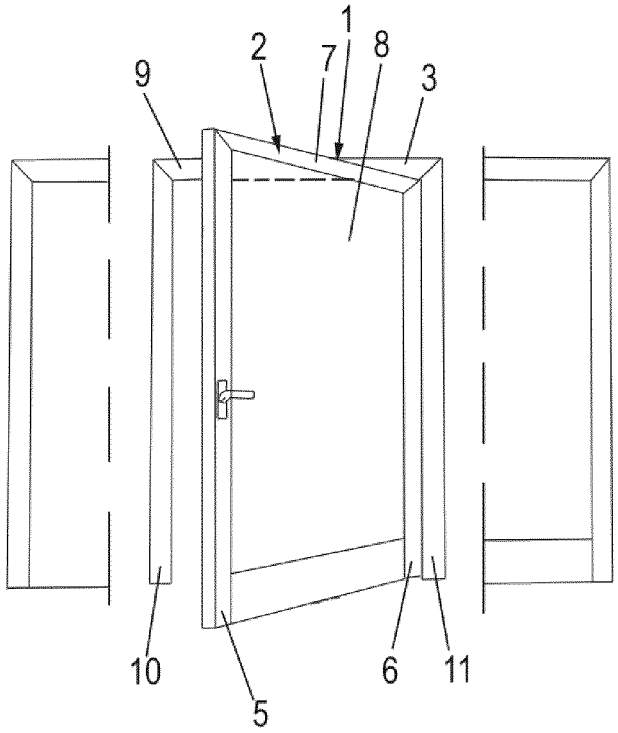
FIG. 1 shows a door comprising a frame and a leaf arranged so it is rotatable thereon, which is shown in an open position.

FIG. 1 shows a door 1, which has a leaf comprising a sash 2, which is arranged on a frame 3. The sash 2 is mounted so it is rotatable on the frame 3 here.

In FIG. 1, the door 1 is shown as a pivoting door comprising door hinges. Alternatively, the door 1 can also be embodied as a sliding door. As an alternative to the door 1 shown in FIG. 1, the present invention can also be applied in windows or façade elements. If the term door is used hereafter, it can therefore also be replaced by the terms "window" or "façade element". The door can be arranged so it is rotatable (vertical axis of rotation) and/or pivotable (horizontal axis of rotation) on the sash.

By way of a corner connection of perpendicular sash spars 5, 6 to an upper horizontal sash spar 7, the profile composite forms the at least U-shaped sash 2. A planar element 8 such as an insulating glass pane or a fire protection glazing or a metal or plastic plate is inserted into the sash 2. The sash 2 and the planar element 8 form the leaf together. The concept of the "window" is also to be understood in the scope of this description and the claims as a fixed glazing comprising a planar element in a frame 3.

The frame 3 of the door 1 is also U-shaped here and has a horizontal frame spar 9 and two vertical frame spars 10, 11.

The sash 2 and/or the frame 3 can alternatively also be designed as circumferentially closed and can have further lower horizontal spars Individual ones or all of the frame spars and/or sash spars have a main profile 300 (frame) or 400 (sash) having a U-shaped cross section.

The main profile 300 and/or 400 can respectively be formed in one piece or multiple pieces as a composite profile. A one-piece variant of the main profile 300, 400 is shown in FIGS. 1, 2*a*, and 2*b* (only 400 here) and two multipiece variants of the main profile 300, 400 are shown in FIGS. 3 and 4 (only 400 here).

Initially, the one-piece variants of the main profile 300, 400 from FIG. 2*a, b, c* will be considered and then the multipiece variants of FIGS. 3 and 4 will be explained.

Figure 2A:
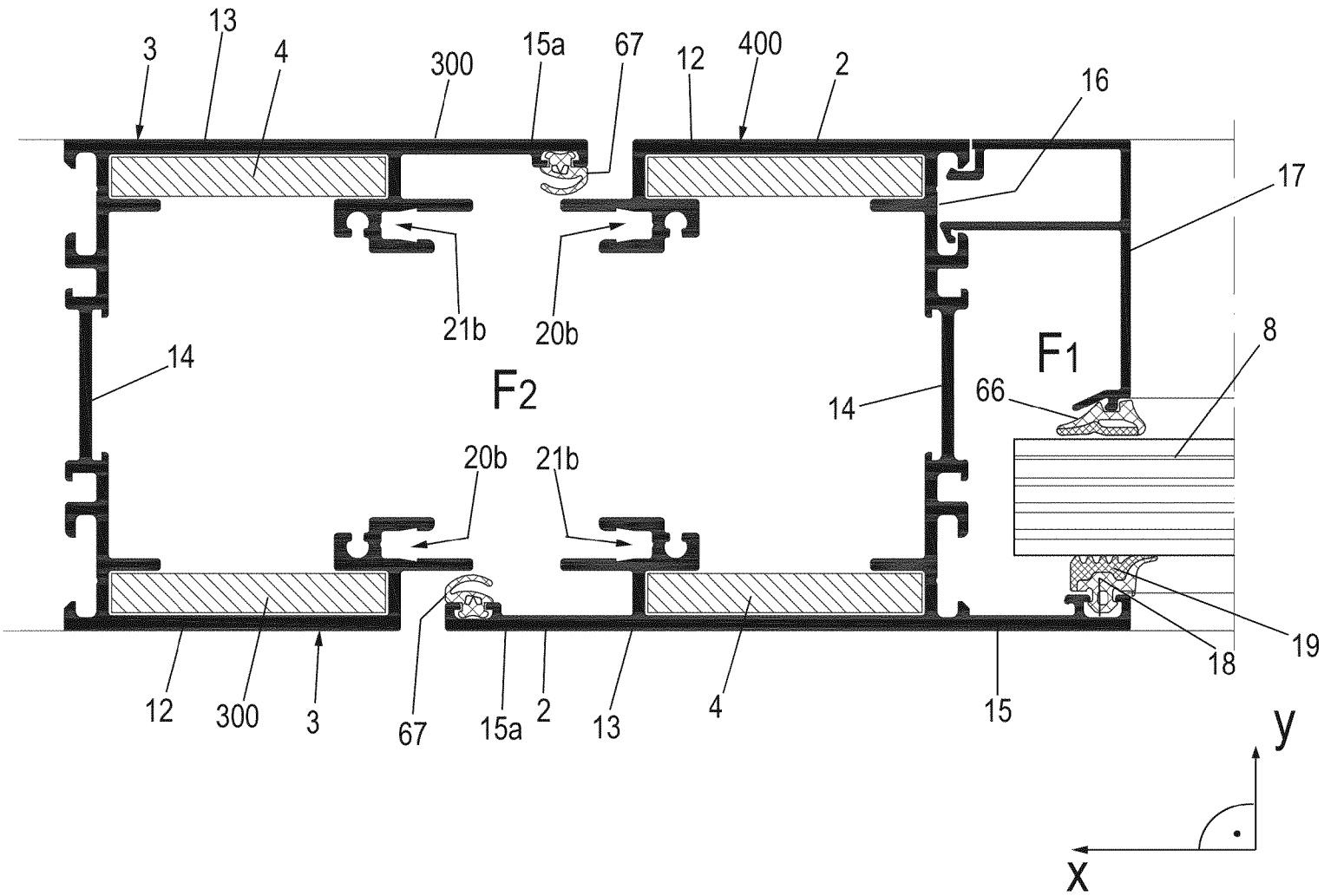
FIG. 2 shows, in a), a section through a sash spar and a frame spar of a door of the type according to FIG. 1, but in the closed state, in b), a sectional illustration of a first main profile of the leaf a), and, in c), a perspective illustration of the main profile from b) in a top view.

According to FIGS. 2*a* and 2*b*, each main profile 300 and/or 400 has a short leg 12 and a long leg 13. The short leg 12 and the long leg 13 extend parallel to one another. They are connected to one another toward the end regions thereof via a transverse leg 14—preferably extending perpendicularly to the short leg 12 and the long leg 13.

The transverse leg 14 forms a base web of the U-shaped main profile 300, 400 and the short leg 12 and the long leg 13 form two parallel longitudinal webs of the U-shaped main profile. According to FIG. 2, the short leg 12, the long leg 13, and the transverse leg 14 are formed in one piece. The main profile 300, 400 of FIG. 2 preferably consists of a metal, in particular of a light metal or a light metal alloy, thus particularly preferably of an aluminum alloy.

The long leg 13 of the main profiles 300, 400 is longer than the short leg 12 in a direction perpendicular to the main extension direction X (see FIGS. 2*c* and 2*b*) of the main profile (i.e., in the section of the image plane of FIG. 2*a*). The directions X and Y extend in the plane of section of FIG. 2*a* or 2*b*. In this case, the short leg 12 and the long leg 13 are formed parallel to one another in the X direction, while the transverse leg 14 extends perpendicularly thereto in the Y direction. The long leg 13 of the main profile 400 of the sash 2 can lie on the outside at a building opening, for example, at a window. Alternatively, however, it can also lie on the inside. Moreover, the main profile 400, 300 can also be a part of a door or a window which lies completely in the building interior and divides or terminates a corridor, for example.

The transverse leg 14 of the sash 2 lies in the sash 2 (FIGS. 2*a*, 3*a*, 3) adjacent to the planar element 8. The transverse leg 14 thus delimits the rabbet space F1 between the main profile 400 and this planar element. A glazing bead 17 (FIGS. 2*a*, 3*f*) and at least one seal 19 can be attached to the transverse leg 14. A further seal 66 (FIGS. 2*a*, 3*a*) can be arranged between the glazing bead 17 and the planar element 8. The short leg and the long leg 12, 13 are aligned parallel to one another.

The long leg 13 of the main profile 400 of the sash 2 protrudes with a free end 15 beyond the transverse leg 14.

A glazing bead groove 16 for fixing a glazing bead 17 is formed outward toward the rabbet space F1 on the transverse leg 14 of the main profile 300, 400. A seal groove 18 for arranging a seal 19 between the planar element 8 and the long leg 13 is provided at the free end 15 of the long leg 13 on the side oriented toward the planar element 8 (see in this regard also FIG. 2*b*, where the main profile 400 has identical contours 16, 18 in this regard).

Both the short leg 12 and also the long leg 13 of the main profile 300, 400 have function contours 20, 21 respectively arranged on the short leg 12 and also on the long leg 13, in particular entirely or partially protruding therefrom, on the inner sides thereof facing toward one another. These function contours 20, 21 are preferably formed as multifunction contours, which fulfill/implement not only one but rather multiple functions.

The multifunction contours according to FIG. 2*b* thus form:

a) a corner connector receptacle groove 20*a*, 21*a* for accommodating a corner connector;
b) a fastening groove 20*b*, 21*b*; and
c) a receptacle groove 20*c*, 21*c* for accommodating a preassembly web 22.

It is advantageous if the function contours 20, 21 form at least two of the above-mentioned grooves a) to c). They particularly preferably each form three or even more of the function grooves or at least parts of this groove/these grooves.

For this purpose, the function contours 20, 21 respectively comprise at least one transverse leg 23 or 24, which protrudes perpendicularly from the short leg 12 or the long leg 13, respectively (see also FIG. 2*b*).

A parallel web 25, 26 is formed in each case at the respective end of these transverse legs 23, 24, which extends parallel to the actual short leg 12 or the long leg 13, but is shorter than these legs. Overall, the respective transverse leg 23, 24 and the parallel web 25, 26 essentially form a T shape in cross section.

In this manner, the short leg 12 or the long leg 13 and the one transverse leg 23 or the other transverse leg 24 and the one parallel web 25 or the other parallel web 26 respectively form the corner connector receptacle groove 20*a*, 21*a*.

The one edge of corner connectors 4 is inserted into each of the corner connector receptacle grooves 20*a*, 21*a*. It is advantageous that the two corner connector receptacle grooves 20*a*, 21*a* are dimensioned equally such that identical corner connectors 4 are usable therein, as this simplifies the assembly of the frame (frame and sash 3, 2).

The other edges of the two corner connectors 4 engage in further corner connector grooves 28*a, b*, which are delimited by short holding webs 29, 30 protruding from the transverse leg 14, the transverse leg 14, and the short leg 12 or the long leg 13, respectively.

The fastening grooves 20*b* and 21*b* are formed by the parallel webs 25, 26 and the angled webs 31, 32 formed thereon on the sides facing toward one another.

The parallel webs 25, 26 and the angled webs 31, 32 thus each form fastening grooves 20*b*, 21*b* open toward a rabbet space F2 toward the frame 3.

These fastening grooves 20*b*, 21*b* are preferably not designed as threaded grooves for the rotating fixing of threaded elements. Rather, they are preferably designed for fixing fastening elements preferably acting in an interlocking and/or frictional manner, which are fixable by a linear movement in the fastening grooves 20*b*, 21*b*. For this purpose, the fastening grooves 20*b*, 21*b* are U-shaped and are each open toward the rabbet space F2 toward the frame 3. This facilitates the insertion of the fastening elements into the fastening grooves 20*b* and 21*b*. Preferably used fastening elements for the fastening grooves 20*b*, 21*b* will be described in greater detail hereafter. The fastening grooves 20*b*, 21*b* preferably have catch means such as one or more undercuts, which can interact with corresponding catch means such as one or more catch edges.

The receptacle grooves 20*c* and 21*c* are used to accommodate the preassembly web 22, which is arranged between the receptacle grooves 20*c* and 21*c* and connects them over the length of the main profile 300 or 400 like a bridge and also in the Z direction in sections or preferably continuously. The preassembly web can extend in the Z direction continuously over the entire length of the main profile 300, 400 or can consist of individual parts, which are each only a few centimeters long and are placed at intervals, for example.

The preassembly web 22 is guided so it is displaceable in the receptacle grooves 20*c* and 21*c* in the main extension direction Z (see FIG. 2*c*) of the main profile 300, 400 in each case perpendicularly to the plane of section of FIG. 2*b*. It is used to form the corner regions of the frame to be produced and holding the short leg 12 and the long leg 13 at a distance in a defined manner during a preassembly—i.e., during the processing before the assembly of the frame—and in this case in particular during the cutting of miter cuts at edges, and is removed during or after the preassembly, preferably after the cutting of the miter cuts. It is embodied sufficiently stably that it counteracts a force compressing the main profile, as can arise during sawing, and therefore a defined distance is maintained between the ends of the short leg 12 and the long leg facing away from the transverse leg 14 during the cutting of the miter cuts.

The receptacle grooves 20*c* and 21*c* are formed as preferably undercut grooves, which are open on sides facing toward one another—in a direction parallel to the transverse leg 14.

The preassembly web 22 has a middle web 22*a* and interlocking contours 33, 34 at the two ends of the middle web 22*a*, using which it is insertable into the receptacle grooves 20*c*, 21*c* and displaceable therein. The interlocking contours 33, 34 are therefore preferably designed corresponding to the cross section of the receptacle grooves 20*c*, 21*c* and therefore they engage with little play therein such that the preassembly web 22 is displaceable in the receptacle grooves 20*c*, 21*c* (perpendicularly to the image plane of FIG. 2*a*). In this manner, the production of the frame spar is optimized and simplified in a simple manner. In particular, it is possible by way of the removable preassembly web 22 to space apart the short leg 12 and the long leg 13 of the main profile 300 or 400 in a defined manner at the ends thereof facing away from the transverse leg 14, in order to carry out miter cuts on the main profile 400 in a simple manner with high accuracy. Before the assembly of the main profiles 300, 400 to form a frame, the preassembly webs 22 are then removed, and therefore space advantageously results for other functional elements in this region. The preassembly webs can consist of, various materials, thus of plastic or aluminum.

Figure 2:
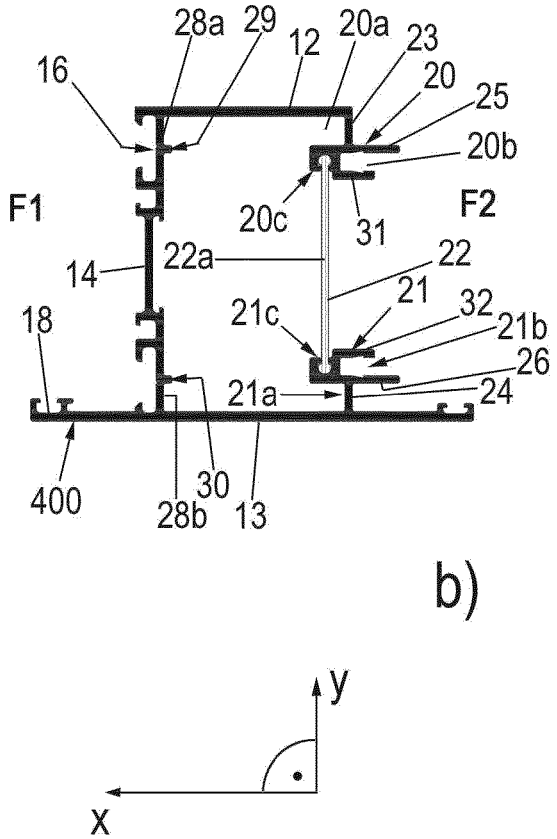
Figure 2:
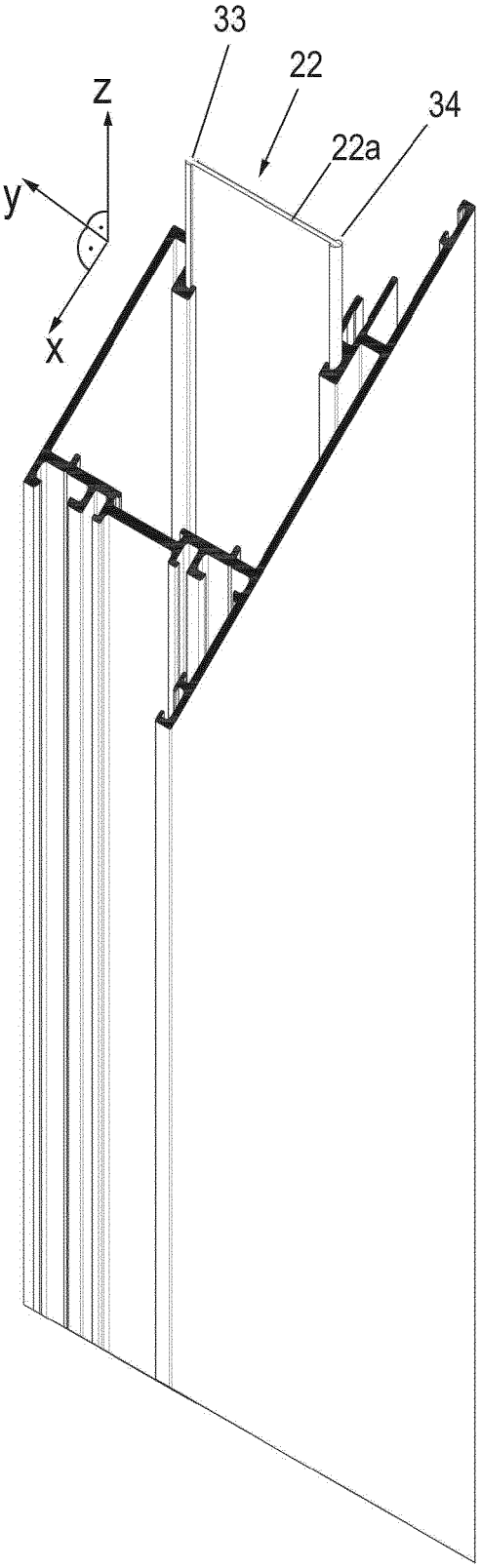

In each of FIGS. 3*a* and 3*b*, the main profile 300, 400 is designed substantially similarly to the main profile or the main profiles of FIG. 2. The above statements are therefore substantially also transferable to the main profiles 300 and 400 of FIGS. 3 and 4 to 10.

However, there are also several differences, which will be explained hereafter.

The main profile 300 or 400, respectively, of FIGS. 3 and 4 is thus formed in multiple pieces as a composite profile.

The main profile 300, 400 of FIGS. 3*a* and 3*b* also has the short leg 12 and the long leg 13 (preferably made of metal, in particular consisting of an aluminum alloy). The short leg 12 and the long leg 13 also extend parallel to one another. Furthermore, they are also connected to one another via a transverse leg 14—preferably extending perpendicularly to the short leg 12 and the long leg 13, wherein the transverse leg 14 forms a base web of the U-shaped main profile 300, 400 and the short leg 12 and the long leg 13 form the two parallel longitudinal webs of the U-shaped main profile 300, 400.

However, the transverse leg 14 of the main profiles 300, 400 of FIGS. 3 and 4 is formed as at least one separate insulating web 39 (FIG. 3*b*) or as multiple insulating webs (FIG. 4: two parallel insulating webs 39*a, b*), which is/are connected in an interlocking and frictional manner to the short leg 12 and the long leg 13, preferably such that a composite which is shear-resistant perpendicular to the plane of FIG. 3*a* is formed.

In this case, at least one insulating web 39 (FIGS. 3, 5) made of insulating material such as plastic can be used or two insulating webs 39*a, b* (FIG. 4) made of insulating material such as plastic can be used.

The at least one insulating web 39 made of plastic can optionally alternatively have a metal main structure or individual metal webs in the plastic, which form bridges between the short leg 12 and the long leg 13 and in this manner optimize the statics (see in this regard by way of example EP 1 138 864 B1 of the same applicant and FIG. 3*e*). The thermal insulation is again locally reduced somewhat in this way. However, a support structure results in this manner, which offers improved thermal insulation in relation to the one-piece transverse leg 14, on the one hand, and is sufficiently stable that it is well suitable for use in fire and/or smoke protection doors, on the other hand.

The short leg and the long leg 12, 13 according to FIG. 3 or 4 are not formed as simple webs made of solid metal as shown in FIG. 2, but preferably are provided with at least one hollow chamber 37, 38. The short leg 12 and the long leg 13 otherwise again consist of a metal, in particular of a light metal or a light metal alloy, thus particularly preferably of an aluminum alloy.

The long leg 13 also protrudes beyond the transverse leg 14 with one free end 15 or two free ends according to FIGS. 3 and 4. The glazing bead groove 16 for fixing the glazing bead 17 is again formed on the transverse leg 14 of the sash main profile 3 toward the rabbet space F1. The seal groove 18 for arranging the seal 19 between the planar element 8 and the long leg 13 is provided at the free end 15 of the long leg 13 on the side oriented toward the planar element 8.

The corner connector receptacle grooves 20*a*, 21*a* can also be used for accommodating fire protection strips having cooling effect, in particular in the regions of the main profiles 300, 400 adjoining the corner connectors.

Both the short leg 12 and also the long leg 13 have the function contours 20, 21 on the inner sides thereof facing toward one another. These function contours 20, 21 are also preferably formed according to FIGS. 3*a* and *b* and 4 as multifunction contours, which fulfill/implement not only one but rather multiple functions. The multifunction contours of FIGS. 3 and 4 even thus advantageously each form four function grooves here:

a) the corner connector receptacle groove 20*a*, 21*a* for accommodating one corner connector 4 in each case;
b) the fastening groove 20*b*, 21*b;*
c) the receptacle groove 20*c*, 21*c* for accommodating the preassembly web 22, and
d) respectively one receptacle groove 20*d*, 21*d* for accommodating a cooling strip 65 between the corner connector receptacle groove 20*a*, 21*a* and the fastening groove 20*b*, 21*b*.

Both the corner connector receptacle groove 20*a* for accommodating the corner connectors 4 and also the receptacle groove 20*d* for accommodating the cooling strips 65 are each formed in this case in the hollow chambers 37, 38 of the short leg 12 or the long leg 13, respectively. Cooling strips 65 are those strips which can absorb a certain amount of fire heat or energy and/or can actively cool in case of fire. They can consist of a molded body having a high heat capacity, for example, of concrete. However, they can also consist of one or more molded bodies which contain heat-binding hydrophilic adsorbent (see, for example, DE 197 00 696 C and DE 4443762 A1). The receptacle grooves 20*d*, 21*d* for respectively accommodating a cooling strip 65 can be seen in FIGS. 3*a* and 3*d* and also 3*f* and 4.

For this purpose, the functional contours 20, 21 each in turn comprise (see, for example, FIG. 4) a short transverse leg 23 or 24 at the short leg 12 or the long leg 13, respectively.

A parallel web 25, 26 is formed at the respective end of these transverse legs 23, 24, respectively, which extends parallel to the inner profile 12 or the outer profile 13 but is shorter than these. Overall, the respective transverse legs 23, 24 and the parallel webs 25, 26 essentially form a T shape in cross section. In this manner, the inner profile 12 or the outer profile 13 and the one transverse leg 23 or the other transverse leg 24 and the one parallel web 25 or the other parallel web 26 respectively form the corner connector receptacle groove 20*a*, 21*a*.

Figure 3F:
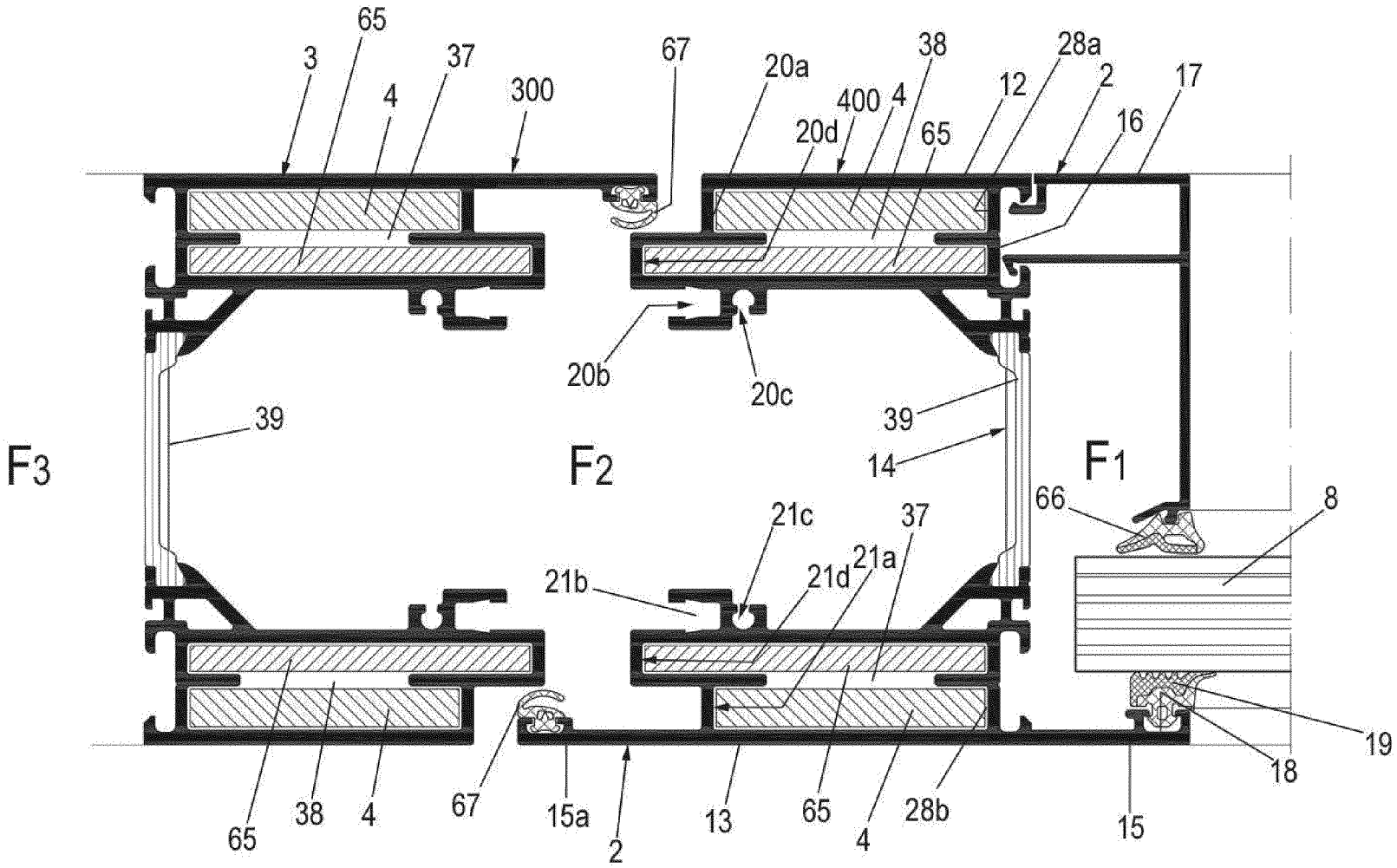

The edges of a total of two corner connectors 4 are in turn inserted into each of the corner connector receptacle grooves 20*a*, 21*a* (see FIGS. 2*a* and 3*f*). It is advantageous that the two corner connector receptacle grooves 20*a*, 21*a* are dimensioned identically such that identical corner connectors 4 are usable therein, since this simplifies the assembly of the window and the stock keeping. Moreover, identical corner connectors are also usable both in the main profiles 400 of the sash 2 and also into the main profile 300 of the frame 3.

The edges of the two corner connectors 4 engage in the further corner connector grooves 28*a, b*, which are delimited by short holding webs 29, 30 formed in the hollow chambers 37, 38, the transverse leg 14, and the short leg 12 and the long leg 13.

The fastening grooves 20*b* and 21*b* are delimited by webs 40, 41 of the short leg 12 and the long leg 13 and are partially formed with them, which delimit the hollow chambers 37, 38 toward the transverse leg 12 or on the sides facing toward one another, and angled webs 31, 32 formed thereon on the sides facing toward one another.

In this manner, the further (parallel) webs 40, 41 and the angled webs 31, 32 each form the fastening grooves 20*b*, 21*b* open toward the further rabbet F2 toward the frame. These fastening grooves 20*b*, 21*b* are preferably not designed as threaded grooves for the rotating fixation of threaded elements. Rather, they are preferably designed for fixing fastening elements preferably acting in an interlocking and frictional manner, which are fixable by a linear movement in the fastening grooves 20*b*, 21*b*. However, the fastening grooves 20*b*, 21*b* are also formed for this purpose in FIG. 3 and FIG. 4 such that they are U-shaped and are each open toward the rabbet F2 toward the frame 3. The fastening grooves 20*b*, 21*b* are preferably formed like simple undercut grooves. They are thus easily structurally implementable on the main profile 300, 400.

The receptacle grooves 20*c* and 21*c* are in turn used to accommodate the preassembly web 22, which is arranged between the two receptacle grooves 20*c* and 21*c* and continuously connects them. The preassembly web 22 is formed as shown in FIG. 2*b, c*. The receptacle grooves 20*c* and 21*c* are formed as undercut grooves, which are open on sides facing toward one another—in a direction parallel to the transverse leg 14. They are formed on the sides of the webs 40, 41 facing toward one another.

In FIG. 4, the main profile 400 is designed substantially similarly to that of FIG. 3. The insulating web 39 consists of two individual webs extending parallel to one another, however, which lie almost together and are each connected in an interlocking and frictional manner like a shear-resistant composite to the short leg 12 and the long leg 13.

Because the preassembly web 22 has been removed after the application of the miter cuts (which is possibly preceded by powder coating of the main profile 400), the main profile is open between the short leg 12 and the long leg 13 on the side facing away from the main leg 14. This is the side lying toward the rabbet F2, i.e., toward the frame 3.

FIGS. 2 and 3 illustrate that it is possible to design the main profiles 300 of the frame 3 as substantially structurally equivalent to the main profiles 400. Nearly all statements on the sash 2 that have been made above thus also apply to the frame 3. The frame 3, however, has a first outer rabbet region F3 not facing toward a planar element but rather toward masonry and a second rabbet region, which is the rabbet region F2 between the sash 2 and the frame 3.

One difference is that in the main profile 400 of the sash, a longer web (the free end 15) is provided on the outer profile 13 than on the main profile of the frame 3. This longer web is used to cover the planar element 8 in the edge region and holding it around the seal 19 toward the planar element 8 (FIG. 3*f*). Toward the rabbet F2, both the main profile 400 of the sash 2 and also the main profile 300 of the frame 3 has a free end 15*a* on the outer profile 13, to laterally terminate the rabbet F2.

A further seal 67, to seal the rabbet F2, is arranged on each of these further free (protruding) ends 15*a* on the inside toward the rabbet F2. The contours of the main profile 300 of the frame 3 and the main profile 400 of the sash 2 are identical toward the rabbet F2 but are located diagonally opposite to one another.

A second difference between the main profiles 300 and 400 of the frame 3 and the sash 2 is that the short leg 12 and the long leg 13 are located diagonally opposite to one another on the installed window or on an installed door (see FIG. 3*f*). The short leg and the long leg 12, 13 are again aligned parallel to one another.

It can be desirable and can be considered to be advantageous if it is possible to again close the open side of the U-shaped main profile 300, 400 toward the rabbet F2 between the frame 3 and the sash 3 (for example, after the removal of the preassembly profile 22) using a visually appealing element, and advantageously to form a dust and vision protection toward the rabbet F2 in a simple manner. Moreover, a more visually appealing view toward the rabbet F2 is desired than offered by the preassembly profile 22.

It is therefore advantageous if, as illustrated in FIG. 5, the open side of the main profile 300, 400 of the sash spar and/or the frame spar located toward the rabbet F2 is entirely or partially covered using at least one or more cover elements, in particular one or more cover profile(s) 42. It is thus advantageous that the fastening grooves 20*b*, 21*b* are usable for fixing such a cover element or are preferably also used in the final installation state.

The cover profile 42 preferably lies completely between the short leg 12 and the long leg 13 and terminates flush with these two legs 12, 13 on the side facing away from the transverse leg 14. The cover profile 42 aligns there with two transverse webs 35, 36, with which it defines a or the visible plane E1. The free space or gap between the short leg 12 and the long leg 13 is thus simply covered in a visually appealing manner. This is the primary function of the cover profile. According to one preferred variant, it is not an element statically supporting and elevating the stability of the main profile 400, 300 in a noticeable manner between the ends of the short leg 12 and the long leg 13 facing away from the transverse leg 14. Rather, it primarily has the function of a visual cover, a dust and dirt safeguard, and possibly a fire protection function, the latter in an optional embodiment and design which will be explained in greater detail hereafter. Alternatively, however, it is also conceivable that the cover profile connects the two legs 12, 13 statically as a (thermally) insulating element. Alternatively, however, it is also conceivable that the cover profile connects the two legs 12, 13 statically as a (thermally) insulating element.

It is advantageous that the short leg 12 and the long leg 13 end in the region of the transverse webs 35, 36 at the ends of the parallel webs 25, 26 externally at the common plane E1 parallel to the transverse leg 14 (Y direction).

The cover profile 42 of FIG. 5 and the following figures is U-shaped in cross section in each case. It has two catch feet 43, 44 (FIG. 6*a*), which are connected to one another by a cover leg 45 extending transversely thereto, as fastening elements and as counter catch means to the catch means of the fastening grooves 20*b*, 21*b*. The catch feet 43, 44 each engage in one of the two fastening grooves 20*b*, 21*b*, which are open toward the rabbet F2 and have undercuts 46 to establish a catch connection. The catch feet 43, 44 are insertable perpendicularly to the transverse leg into the fastening grooves 20*b*, 21*b*. The catch feet 43, 44 are preferably designed as combined catch/clamping feet, which engage not only in a locking manner but rather also somewhat in a clamping manner in the fastening grooves 20*b*, 21*b*. Nonetheless, the cover profile 42 remains easily displaceable in the fastening grooves 20*b*, 21*b* in the longitudinal direction thereof.

The catch feet 43, 44 can have greatly varying geometries. They can consist, for example, of solid material and can have outer catch edges (FIG. 6*a*) or can each be formed from two individual webs 45*a, b* having catch edges, which are elastically compressed upon insertion (FIG. 6*b*) or can be formed as hollow webs (FIGS. 6*c* to 6*f*), which are elastically compressed upon insertion into the fastening grooves 20*b*, 21*b*.

The cover profile or profiles 42 can moreover be formed in one piece or multiple pieces. Moreover, they preferably consist of plastic (such as PVC, PP) or a fire protection material or a combination of these two materials. If they consist of a combination of these two materials, they preferably have a U-shaped fire protection bridge 47, with which the catch feet 43, 44 are associated, and a transverse web or cover leg 45 connecting them, which forms a part of the cover profile 42. The cover profiles 42 are preferably composed and designed such that required pieces can be cut off from them easily, for example, using scissors.

The cover leg 45 is preferably enclosed or covered on one of its sides or on both sides and/or at least in corner regions using fire protection material, and therefore fire protection regions 48 are formed (FIG. 6*d*). In this case, a cover layer 49 can be provided on the cover leg 45 toward the rabbet. It can consist of arbitrary material. It is preferably formed as a hard plastic layer or plate and is, for example, poured on or adhesively bonded or was formed in the coextrusion method. The fire protection regions 48 consist of a fire protection material. This is a material which foams under the effect of temperature in case of fire and can seal the rabbet F2. The access of hot flames and/or fire gases to the rabbet between the frame and the sash is thus made more difficult or blocked entirely for some time (see, for example, DE 19700696 B4 on the background of these technologies).

As stated, in this manner a preferably planar surface toward the inside toward the rabbet F2 is implemented in a simple manner. In the longitudinal direction transverse to the image plane of FIG. 5, the entire gap between the short leg 12 and the long leg 13 or a part thereof can be covered.

The region of a lock assembly 50, which can be installed on the main profile 400 in a manner to be described hereafter, is preferably not covered by the cover profile.

FIGS. 7 and 8 then illustrate a further advantageous option of the invention. According to this option, profile clamps 51 are arranged on the main profile 400. In the meaning of this application, the profile clamps 51 are fitting parts which consist of metal.

One of the profile clamps 51 is depicted in FIG. 8. This profile clamp 51 has, in the side view of FIG. 8*c*, a U shape comprising a main leg 51*a* and two short longitudinal legs 51*b*, 51*c*. The main leg 51*a* can be provided with one or more reinforcing beads. The two longitudinal legs 51*b, c* are U-shaped per se. They form catch sections, each of which are designed to engage in one of the fastening grooves 20*b*, 21*b*. For this purpose, they have an angle 52 bent outward on the one hand, and a catch web 53 stamped out and bent over on three sides, on the other hand, wherein the angle 52 and the catch web 53 each form catch edges, which are designed to engage behind the undercuts 46 in the fastening grooves 20*b*, 21 in a locking manner (see, for example, FIG. 2*a*). In this case, the catch edges are preferably formed so sharp-edged that they claw fixedly into the fastening grooves, and therefore they are not displaceably seated but rather are seated fixedly therein in the main extension direction of the main profile 300 or 400, respectively. In the main extension direction Z of the main profile 300, 400, the profile clamps are preferably 10 to 50 mm long, in particular 20 mm to 40 mm. Furthermore, they are placed spaced apart from one another in the main extension direction Z, in particular at an interval of 300 to 800 mm, preferably 400 to 600 mm. They do not burn off in case of fire and therefore also stabilize the main profile 300, 400 in particular in case of fire. Moreover—in contrast to the cover profiles 42, they are connected to the main profile 300, 400 in a shear-resistant manner.

The main leg 51*a* is dimensioned sufficiently long in this case that it overlaps the spacing between the fastening grooves 20*b*, 21*b*. The profile clamps 51 are preferably formed from sheet steel. This sheet steel is preferably very thin and preferably has a thickness between 0.5 and 1.5 mm. It is formed into a stamped/bent part. Because the profile clamps 51 consist of steel, they can be designed very stably. They are locked spaced apart from one another into the fastening grooves 20*b*, 21*b* and cut into the light metal of the main profile 300 or 400 therein. In this manner, they stabilize the main profile 400 of the sash or the main profile 300 of the frame, respectively, and hold the short leg 12 and the long leg 13 at a distance in a defined manner.

The profile clamps 51 are first locked on when possible miter cuts have been carried out on the main profile 300 or 400 and when the preassembly web 22 has been removed. In this manner, they cannot damage a saw or a saw blade during the sawing of the miter cuts. On the other hand, they have a very stabilizing effect on the profile, without noticeably increasing its weight. Because the longitudinal legs 51*b*, 51*c* of the profile clamps 51 are themselves U-shaped, it is even possible to also place the cover profile 42 on the profile clamps 51, when they have been fixed on the main profile 400 or 300, respectively, the cover profile then lying above the profile clamps 51 in the region thereof, and therefore they are not visible in the installed state. FIG. 7*a* illustrates this. The profile clamps then lie inside from the cover profiles 42.

The profile clamps 51 are locked on (like the cover profiles 42), preferably in the X direction perpendicular to the transverse leg 14.

At least one of the profile clamps 51 is preferably attached in each case on the main profile 400 of the sash 2 where a fitting assembly, by way of example and preferably, a lock assembly 50, is to be attached. This is typically a lock assembly 50 comprising a lock 54 with cylinder and one or more movable bolt(s) on the sash. The profile clamps 51 or one of the profile clamps 51 is arranged vertically directly below the lock assembly 50, and therefore it is additionally secured and vertically fixed on the main profile 400.

A preferred lock assembly 50 is shown in FIG. 9. This lock assembly consists of the actual lock 54, wherein the lock 54 has a striker plate 55, which is penetrated by one or more bolts 56.

The striker plate 55 is fixed on a carrier element 59 or is embodied in one piece with the carrier element. The striker plate 55 preferably has one or more boreholes 57, which can be penetrated by screws or one screw 58 in each case. The screw 58 is designed in each case for the purpose of engaging in a carrier element 59.

Similarly, another fitting assembly has a fitting plate fixed on the carrier element 59 or is embodied in one piece with the carrier element.

The carrier element 59 is preferably formed as a profile section. In particular, it is a profile section of a light metal profile, in particular an aluminum profile. It is theoretically also conceivable to form the carrier element not as a profile section but rather as a stamped/bent part or the like or as a cast part.

The screw 58 can be screwed into the carrier element 59 to fasten the lock. It can also have a central screw borehole 60 for this purpose.

The carrier element 59 (see FIG. 10) moreover preferably and advantageously has a U shape (in a side view) having a main leg 59*a* and two longitudinal legs 59*b*, 59*c*. In this case, the two longitudinal legs 59*b*, 59*c* have counter catch means for the catch means of the fastening grooves 20*b*, 21*b* directly or indirectly at the ends thereof.

The longitudinal legs 59*b*, 59*c* are in turn spaced apart from one another such that they can engage in the fastening grooves 20*b*, 21*b* of the main profile (400 or 300). They are preferably not directly but rather indirectly locked therein. They are thus designed for the purpose of engaging in securing clips 61, 62. For this purpose, the securing clips 61, 62 have catch edges 63, 64 at both ends thereof. These catch edges 63, 64 are provided at both ends in the securing clips 61, 62, which are U-shaped in cross section. Using them, the securing clips 61, 62 can be preinstalled on the carrier element 59. After the fastening of the fastening clips 61, 62, the entire lock assembly 50 can be inserted into the fastening grooves 20*b*, 21*b*, which in turn hold the lock assembly 50 in a locking manner (for example, like a so-called "hawk mouth").

The securing clips 61, 62 preferably consist of plastic. In this manner, greatly varying devices, in particular the pre-installed lock assembly 50 or other fitting parts or the like, can be fixed on the main profile 400 or 300 using the securing clips. In this manner, the lock assembly 50 comprising the lock 54 is securely fastened in a simple manner on the main profile 400 of the sash 2. In addition, the lock assemblies 50—as already described above—are fixed and/or secured against slipping using the profile clamps 51 on the main profile 400.

The carrier element 59 or the carrier elements can also be used for the simple and preferably tool-free fixing of another element or an assembly other than a lock assembly on the respective main profile 300, 400. Other fitting assemblies and parts can thus be fastened on the main profile 300, 400 in a simple and preferably tool-free manner using them.

FIG. 11 shows the assembly from FIG. 7, supplemented with a fitting screen 67 designed as a lock screen. In this case, FIG. 11*a*) shows a perspective view and FIG. 11*b*) shows a sectional view of the arrangement from a). FIG. 12 shows various views of the lock screen from FIG. 11. The fitting screen 67 is formed as a rectangular frame. It in turn has small inwardly protruding webs 68 on its inner circumference, which are designed for the purpose of engaging behind the striker plate 55.

The striker plate 55 lies externally on the two transverse webs 35, 36 on the main profile 400 and thus lies on the visible plane E1. The lock screen 67 is held by the striker plate 55, since the webs 68 engage behind it. In this manner, the main profile 300, 400 is also made visually appealing in a simple manner in the region of the lock assembly.

FIG. 13 shows a corner region of a sash. Another fitting assembly 69, which has as the function element a pin 70, 71, which is arranged on a fitting plate 73, is fixed on the sash here like the lock assembly from FIGS. 7 and 11. This fitting plate is enclosed by a fitting screen 71 like a frame. The fitting screen 71 is again formed as a rectangular frame, which has several small inwardly protruding webs 72 on its inner circumference, which are designed for the purpose of engaging behind the striker plate 55.

The striker plate 55 lies externally on the two transverse webs 35, 36 on the main profile 400 and thus lies on the visible plane E1. The fitting screen 71 is again held by the striker plate 55, since the webs 68 engage behind it. In this manner, the main profile 300, 400 is also made visually appealing in a simple manner in the region of the lock assembly. Moreover, the fitting assembly is again fixed at the fastening grooves 20*b*, 21*b* using the carrier element and preferably using a hawk mouth fastening (not visible here).

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS door 1
sash 2
frame 3
corner connector 4
sash spars 5, 6
sash spar 7
planar element 8
frame spars 9, 10, 11
short leg 12
long leg 13
transverse leg 14
free end 15, 15*a*
glazing bead groove 16
glazing bead 17
seal groove 18
seal 19
function contours 20, 21
corner connector receptacle groove 20*a*, 21*a*
fastening groove 20*b*, 21*b*
receptacle groove 20*c*, 21*c*
receptacle groove 20*d*, 21*d*
preassembly web 22
transverse web 23, 24
parallel web 25, 26
groove 26, 27
corner connector grooves 28*a, b*
holding webs 29, 30 angled webs 31, 32
interlocking contours 33, 34
transverse webs 35, 36
hollow chambers 37, 38
insulating webs 39, 39*a*, 39*b*
webs 40, 41
cover profile 42
catch feet 43, 44
cover legs 45
undercuts 46
plastic bridge 47
fire protection region 48
cover layer 49
lock assembly 50
profile clamps 51
main legs 51*a*
longitudinal legs 51*b*, 51*c*
angle 52
catch web 53
lock 54
striker plate 55
bolt 56
borehole 57
screw 58
carrier element 59
base leg 59*a*
longitudinal legs 59*b, c*
thickened areas 59*d, e*
screw borehole 60
securing clips 61, 62
catch edges 63, 64
cooling strip 65
seal 66
fitting screen 67
webs 68
fitting assembly 69
pin 70
fitting screen 71
webs 72
fitting plate 73
main profile 300, 400
rabbet spaces F1, F2, F3
plane E1

The invention claimed is:

1. A window, door, or façade element comprising:

a frame made of frame spars;

a sash made of sash spars;

a fitting assembly, wherein a first side of the fitting assembly has a lock screen and a second side of the fitting assembly has first and second fasteners, wherein the first side of the fitting assembly is opposite the second side of the fitting assembly; and a main profile comprising first and second fastening grooves that open in a same direction, wherein the first and second fasteners of the fitting assembly are fixed in first and second fastening grooves so that the fitting assembly bridges an intermediate space between the first and second fastening grooves, wherein the first and second fastening grooves have at least one catch for at least one counter catch of the fitting assembly, and wherein the fitting assembly has a lock on a striker plate and at least one carrier element for carrying the striker plate, wherein the carrier element locks in the first and second fastening grooves via the counter catch.

2. The window, door, or façade element of claim 1, wherein the striker plate and the at least one carrier element comprise multiple pieces and are fastened on one another.

3. The window, door, or façade element of claim 1, wherein the striker plate and the at least one carrier element are a single piece.

4. The window, door, or façade element of claim 1, wherein two of the carrier elements are formed on the striker plate.

5. The window, door, or façade element of claim 1, wherein the first and second fastening grooves extend over an entire length of the main profile in a main extension direction of the main profile.

6. The window, door, or façade element of claim 1, wherein the fitting assembly is displaceable with the carrier element after locking on the main profile in the first and second fastening grooves in a main extension direction of the main profile.

7. The window, door, or façade element of claim 1, wherein the fitting assembly is additionally fixed and/or secured against slipping on the main profile using a profile clamp arranged vertically below the fitting assembly.

8. The window, door, or façade element of claim 1, wherein the carrier element has, in cross-section, a U shape having a main leg and two parallel longitudinal legs.

9. The window, door, or façade element of claim 1, wherein the two parallel longitudinal legs are spaced apart from one another such that they are engageable in the first and second fastening grooves of the main profile, and the counter catch for interacting with the catch of the first and second fastening grooves are formed directly or indirectly at the ends of the two longitudinal legs.

10. The window, door, or façade element of claim 9, wherein the two longitudinal legs have thickened areas at the ends thereof, which each engage in securing clips, which are lockable in the two fastening grooves.

11. The window, door, or façade element of claim 10, wherein the securing clips consist of a plastic material.

12. The window, door, or façade element of claim 1, wherein the at least one carrier element is a profile section of a metal profile.

13. The window, door, or façade element of claim 1, wherein the fitting assembly is installable without tools on the main profile.

14. The window, door, or façade element of claim 1, wherein the lock screen has inwardly protruding webs on its inner circumference, which are engageable behind the striker plate.

15. The window, door, or façade element of claim 1, wherein the first and second fastening grooves are part of function contours, each of which have a transverse leg protruding perpendicularly from a short leg of the main profile or a long leg of the main profile, respectively, and also at least one angled web.

16. The window, door, or façade element of claim 15, wherein the transverse leg is formed entirely or partially as at least one separate insulating web or multiple insulating webs, which is/are connected in an interlocking and frictional manner to the short leg and the long leg such that a shear-resistant composite is formed.

* * * * *